US007511679B2

(12) United States Patent
Araki et al.

(10) Patent No.: US 7,511,679 B2
(45) Date of Patent: Mar. 31, 2009

(54) ANTENNA, AND RADIO TIMEPIECE USING THE SAME, KEYLESS ENTRY SYSTEM, AND RFID SYSTEM

(75) Inventors: Hirokazu Araki, Saitama-ken (JP); Masahiro Mita, Saitama-ken (JP); Chiharu Mitsumata, Gunma-ken (JP)

(73) Assignee: Hitachi Metals Ltd., Tokyo (JP)

( * ) Notice: Subject to any disclaimer, the term of this patent is extended or adjusted under 35 U.S.C. 154(b) by 500 days.

(21) Appl. No.: 10/549,483

(22) PCT Filed: Nov. 29, 2004

(86) PCT No.: PCT/JP2004/017740

§ 371 (c)(1),
(2), (4) Date: Sep. 15, 2005

(87) PCT Pub. No.: WO2005/053096

PCT Pub. Date: Jun. 9, 2005

(65) Prior Publication Data

US 2006/0214866 A1 Sep. 28, 2006

(30) Foreign Application Priority Data

Nov. 27, 2003 (JP) ..... 2003-397989
Dec. 11, 2003 (JP) ..... 2003-413642

(51) Int. Cl.
*H01Q 7/08* (2006.01)

(52) U.S. Cl. ..... 343/788; 343/718; 343/895

(58) Field of Classification Search ..... 343/788, 343/718, 895
See application file for complete search history.

(56) References Cited

U.S. PATENT DOCUMENTS

| | | | | |
|---|---|---|---|---|
| 5,005,690 | A * | 4/1991 | Gonser | 198/350 |
| 5,696,518 | A | 12/1997 | Itoh et al. | |
| 7,023,395 | B2 * | 4/2006 | Ohara et al. | 343/788 |
| 7,061,439 | B1 * | 6/2006 | Minami et al. | 343/718 |
| 7,170,462 | B2 * | 1/2007 | Ihara et al. | 343/788 |
| 7,321,337 | B2 * | 1/2008 | Ikeda et al. | 343/718 |
| 2007/0008235 | A1 * | 1/2007 | Tsukahara et al. | 343/788 |
| 2007/0024516 | A1 * | 2/2007 | Araki et al. | 343/788 |
| 2007/0139288 | A1 * | 6/2007 | Shigemoto | 343/788 |

FOREIGN PATENT DOCUMENTS

| | | |
|---|---|---|
| EP | 0 703 513 A1 | 3/1996 |
| GB | 2 361 110 A | 10/2001 |
| JP | 55-08504 | 6/1980 |
| JP | 61-219109 | 9/1986 |
| JP | 08-271659 | 10/1996 |

(Continued)

OTHER PUBLICATIONS

European Search report dated Jul. 9, 2008 for European Application No. 04819477.3 corresponding to PCT/JP 2004017740, Applicant Hitachi Metals Ltd.

*Primary Examiner*—Tan Ho
(74) *Attorney, Agent, or Firm*—Finnegan Henderson Farabow Garrett & Dunner LLP

(57) ABSTRACT

A magnetic sensor-type antenna comprising a magnetic core and a coil wound around the magnetic core for receiving electromagnetic waves, which is disposed in a housing such that the end portion of the magnetic core is bent away from the housing or a metal portion of the housing, and a timepiece, a keyless entry system and an RFID system each comprising such an antenna.

35 Claims, 15 Drawing Sheets

FOREIGN PATENT DOCUMENTS

| | | |
|---|---|---|
| JP | 11-353561 | 12/1999 |
| JP | 2002-168978 | 6/2002 |
| JP | 2002-341059 | 11/2002 |
| JP | 2003-110341 | 4/2003 |
| JP | 3512782 | 1/2004 |
| JP | 2004-128956 | 4/2004 |

* cited by examiner

ANTENNA, AND RADIO TIMEPIECE USING THE SAME, KEYLESS ENTRY SYSTEM, AND RFID SYSTEM

FIELD OF THE INVENTION

The present invention relates to a magnetic sensor-type, radio wave-receiving antenna suitable for radio-controlled timepieces receiving radio waves including time information for time adjustment, smart keyless entry systems for detecting the access of owners by radio waves to open keys of automobiles or a houses, etc. (hereinafter referred to as "keyless entry systems"), or RFID tag systems for giving and receiving information by modulation signals carried by radio waves (hereinafter referred to as "RFID systems"), etc.

BACKGROUND OF THE INVENTION

A radio-controlled timepiece receiving time information conveyed by a carrier wave having a predetermined frequency to adjust its own time based on that time information has been finding various applications such as clocks, wristwatches, etc.

The radio waves used for the radio-controlled timepieces, etc. are 40-200 kHz, having as long wavelengths as several kilometers. Because antennas as long as more than several hundred meters are needed to efficiently receive these radio waves, it is practically difficult to use them in wristwatches, keyless entry systems, RFID systems, etc. Accordingly, magnetic cores having the same function as that of the antennas are generally used for receiving radio waves.

Two radio waves of 40 kHz and 60 kHz are used as carrier waves for time information in Japan. Radio waves having frequencies of 100 kHz or less are mainly used overseas to provide time information. To receive radio waves of these frequencies, magnetic sensor-type antennas having coils wound around magnetic cores are mainly used.

A wristwatch is mainly constituted by a housing, a movement (driver module) and its peripheral parts (dial, motor, battery, etc.), a non-metal (glass) cover, and a rear metal cover. When an antenna is contained in a wristwatch, it is conventionally disposed outside the housing in many cases.

However, the recent trend of reducing size and weight has required an antenna to be disposed in a housing. FIG. 23 shows one example of wristwatches containing an antenna in a housing. As shown in FIG. 23, it should be noted that a movement 92, a rear cover 94, and peripheral parts 96 such as a battery, a motor for moving a pointer, etc. are disposed in a housing 95, and an antenna 1 is placed in a gap between the movement 92 and the rear cover 94. Though the antenna 1 is shown by a solid line in the front view of FIG. 23, the antenna 1 is contained in a closed space defined by the housing 95, the movement 92, the peripheral parts 96 and the rear cover 94. Thus, the antenna 1 is not actually seen from front.

When a radio wave coming from outside passes through a magnetic core, voltage is induced in a coil. As shown in the equivalent circuit of FIG. 22, this voltage resonates at a desired frequency by a coil 8 and a capacitor C connected to the coil 8 in parallel. A Q-times voltage is generated in the coil 8 by resonance, to cause current to flow. This resonance current causes the coil 8 to generate a magnetic field, whose magnetic flux mainly flows in and out of both ends of the magnetic core. If there is a metal around the antenna, the magnetic flux generated by this resonance current penetrates the metal, generating eddy current. Thus, if there is a metal near the antenna, the energy of a magnetic field is lost as eddy current at the time of resonance, resulting in antenna coil loss and thus decrease in a Q value and antenna sensitivity.

JP 2003-110341 A discloses a small antenna comprising a magnetic core constituted by an amorphous metal laminate, and a coil wound around it. JP 8-271659 A discloses a small antenna comprising a magnetic core made of ferrite and a coil wound around it. These small antennas are disposed mainly outside the housings of the wristwatches. From the aspect of not hindering the receiving of radio waves as described above, a wristwatch comprising the antenna described in JP 2003-110341 A or JP 8-271659 A preferably has a resin housing.

However, the resin housing poses restrictions in design and ornamentation. Generally, design is a selling point for wristwatches, and metal housings are preferred for high-quality impression and beautifulness. Accordingly, most high-quality timepieces have metal housings. However, if the small antenna described in JP 2003-110341 A or JP 8-271659 A is mounted in a wristwatch with a metal housing the metal housing acts as a radio wave shield, resulting in drastic reduction of receiving sensitivity.

JP 2002-168978 A discloses an antenna comprising a conductive seal member between a metal housing and an antenna. The antenna of this reference is disposed outside the metal housing via a shield member to keep a Q value. However, because the seal member is indispensable, it suffers restrictions in size reduction and design.

Japanese Patent 3,512,782 discloses an antenna comprising a magnetic main path member comprising a coil wound around a magnetic core, and a magnetic sub-path member comprising a magnetic core without a coil, an air gap being provided in part of a closed magnetic loop along the magnetic core, such that a magnetic flux generated inside at the time of resonance less leaks outside. Japanese Patent 3,512,782 describes that this antenna selectively guides a magnetic flux flowing outward at the time of resonance to the magnetic sub-path member, thereby making the magnetic flux less likely to leak outside to suppress the reduction of a Q value due to an eddy current loss.

Keyless entry systems and RFID systems also suffer the problem that a metal hinders an antenna from transmitting and receiving radio waves. The keyless entry system and the RFID system also contain a magnetic sensor-type antenna disposed in a metal housing or near metal parts. The keyless entry system capable of doing the remote control of an automobile key, etc. comprises a receiving unit having an antenna for doing a switching operation by a particular electromagnetic wave, and a unit for transmitting an electromagnetic wave. When a key holder, a transmitting unit, goes close to or away from the receiving unit, a door can be opened or closed without touching the key. The RFID (radio frequency identification) system gives and receives information stored in a tag through an antenna operated at a particular electromagnetic wave. For instance, when an RFID tag, to which destination information, etc. are input, is mounted to a bus, etc., and when an RFID tag, to which timetable information is input, is embedded in a display board, etc. at a bus stop, various transportation information can be seen. In these systems, too, the size reduction and sensitivity increase of an antenna are required.

OBJECT OF THE INVENTION

Accordingly, an object of the present invention is to provide a high-sensitivity magnetic sensor-type antenna disposed in a metal housing, which is free from an eddy current loss without needing large installation area and volume, and a radio-controlled timepiece, a keyless entry system and an RFID system, each of which comprises such magnetic sensor-type antenna.

DISCLOSURE OF THE INVENTION

As a result of intense research in view of the above object, the inventors have found that a high-sensitivity magnetic sensor-type antenna with a suppressed eddy current loss can be obtained without needing a shield by (a) bending end portions of a magnetic core in the antenna in a direction away from a metal housing, (b) providing a magnetic core with a magnetic sub-path member having a smaller specific permeability than that of the magnetic core, or (c) disposing a magnetic core in a magnetic material case. The present invention has been completed based on such findings.

Thus, the first magnetic sensor-type antenna of the present invention comprises a magnetic core and a coil wound around the magnetic core for receiving a radio wave, the antenna being disposed in a housing, and end portions of the magnetic core being bent in a direction away from the housing or a metal part of the housing.

The magnetic core preferably further has bent tip end portions. The magnetic core preferably has pluralities of branched end portions, at least one of which is bent in a direction away from the housing or a metal part of the housing. Also, at least one of the remaining end portions may be bent in a different direction.

End portions of the magnetic core are preferably shaped along an inner wall of the housing. The end portions of the magnetic core are preferably inclined by about 20-50° to a portion having the coil. The tip end portions of the magnetic core are preferably bent such that they are in parallel with the portion having the coil.

The second magnetic sensor-type antenna of the present invention for receiving a radio wave comprises a magnetic main path member comprising a magnetic core and a coil wound around the magnetic core, and a magnetic sub-path member attached to the magnetic core, the magnetic sub-path member having a smaller specific permeability than that of the magnetic core.

In a preferred embodiment, there is a gap of 0.025-3 mm between one end of the magnetic sub-path member and the magnetic core. In another preferred embodiment, the ends of both magnetic sub-path members are positioned in a center portion of the magnetic core with a gap of 0.025-3 mm therebetween.

The magnetic sub-path member preferably has a specific permeability of 2 or more, lower than that of the magnetic main path member. A cross section area ratio of the magnetic sub-path member to the magnetic core is preferably /100-1/2.

A further example of the magnetic sensor-type antenna of the present invention comprises a magnetic main path member comprising a magnetic core and a coil wound around the magnetic core, and a magnetic sub-path member attached to the magnetic core; the magnetic sub-path member being constituted by a first magnetic sub-path member, and a second magnetic sub-path member sandwiched by the first magnetic sub-path member and the magnetic core without an air gap; and the second magnetic sub-path member having a smaller specific permeability than that of the first magnetic sub-path member.

In any magnetic sensor-type antenna, the magnetic core is preferably a bundle of plural metal wires, or a laminate of plural thin ribbons. When the magnetic core is a laminate of plural thin ribbons, the magnetic sub-path member is preferably disposed on a stratum-appearing surface of the magnetic main path member. More preferably, the magnetic sub-path member is a laminate of plural thin ribbons, and disposed such that its lamination direction is the same as that of the magnetic main path member.

The third magnetic sensor-type antenna of the present invention for receiving a radio wave comprises a magnetic core, a coil wound around the magnetic core, and a case receiving the magnetic core and the coil, the case having a specific permeability of 2 or more, smaller than that of the magnetic core.

The magnetic core has a body portion disposed in the case and end portions exposed from the case. The case is preferably constituted by (a) a soft magnetic case portion for receiving a body portion of the magnetic core, and end portions extending from the soft magnetic case portion for receiving the end portions of the magnetic core, the end portions of the case having a smaller specific permeability than that of the soft magnetic case portion, or (b) a soft magnetic case portion for receiving a body portion of the magnetic core, and non-magnetic case portions extending from the soft magnetic case portion for receiving end portions of the magnetic core. In any case, the soft magnetic case portion preferably has a specific permeability of 2 or more.

In the magnetic sensor-type antenna comprising a case, the magnetic main path member is preferably fit in the case. The case is preferably injection-molded, or obtained by curing a curable slurry charged into a mold, in which the magnetic main path member comprising the magnetic core and the coil wound around the magnetic core is placed.

When the magnetic sensor-type antenna is disposed in a metal housing, the end portions of the magnetic core are preferably bent in a direction away from the metal housing. When the magnetic sensor-type antenna is disposed in a metal or non-metal housing together with other metal parts than the antenna, the end portions of the magnetic core are preferably bent in a direction away from the metal parts. The tip end portions of the magnetic core are preferably substantially in parallel with a bottom surface of the metal or non-metal housing.

The radio-controlled timepiece of the present invention comprises any one of the magnetic sensor-type antennas of the present invention in a metal housing.

The keyless entry system of the present invention comprises a transmitter and a receiver, at least one of the transmitter and the receiver containing any one of the magnetic sensor-type antennas of the present invention.

The RFID system of the present invention comprises the antenna of the present invention in an RFID tag.

Because the end portions of the magnetic core in the antenna of the present invention are bent in a direction away from a housing, it is less influenced by the housing even when the housing is made of a metal. Accordingly, even when the antenna is disposed in a radio-controlled timepiece having a metal housing, high sensitivity and Q value can be obtained. In a preferred embodiment, branched tip end portions are spread substantially in parallel with a bottom surface of the housing, the magnetic flux coming from any directions can be captured, resulting in higher sensitivity.

The mounting of a member for forming a magnetic sub-path in addition to the main magnetic circuit provides the following effects: Because a magnetic flux flowing from a magnetic sub-path member also enters a main magnetic path, the amount of a magnetic flux passing through the main magnetic path increases, resulting in higher output voltage. When the case receiving the magnetic main path member constitutes the magnetic sub-path member, a brittle magnetic core can be protected from impact, resulting in high output voltage. The use of a case having such a shape as not to magnetically shut the end portions of the magnetic main path member provides the antenna with little loss.

The construction of a contact portion of the magnetic sub-path member and the magnetic main path member with a low-permeability material, through which a magnetic flux passes therebetween, reduces a plane-passing magnetic flux by fringing, thereby suppressing the generation of eddy current. The adjustment of inductance (magnetic circuit constants) by changing the cross section area of the low-permeability material and its contact area with the magnetic main path member, which can be done precisely, is much easier and better operable than when the adjustment is done by changing an air gap by the positional adjustment of the magnetic main path member and the magnetic sub-path member.

In a preferred embodiment, the magnetic main path member constituted by laminated thin metal ribbons is used, so that a magnetic flux flowing between the magnetic main path member and the magnetic sub-path member substantially passes the end surfaces of the thin metal ribbons of the magnetic main path member. In this case, there is preferably little eddy current generated in the ribbon surface of the magnetic main path member.

Using the antenna of the present invention having the above characteristics, as high sensitivity and Q value as those of radio-controlled timepieces, in which antennas are disposed at positions evading metal housings or metal parts, can be obtained without needing increased installation areas in the radio-controlled timepieces. Accordingly, a radio-controlled timepiece comprising the antenna of the present invention is little restricted in design. In addition, because of little radiation of a magnetic flux by a resonance current, high effective sensitivity is obtained. Such antenna is suitable not only for radio-controlled timepieces, but also for keyless entry systems, RFID systems, etc.

DESCRIPTION OF THE PREFERRED EMBODIMENTS

Figure 1A:
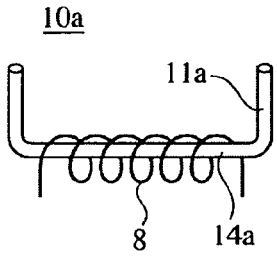
FIG. 1 is a schematic view showing an example of the antenna of the present invention.
Figure 1B:
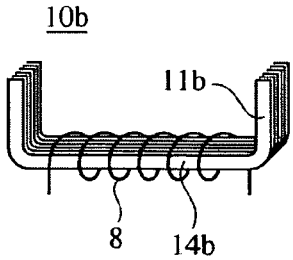
Figure 1C:
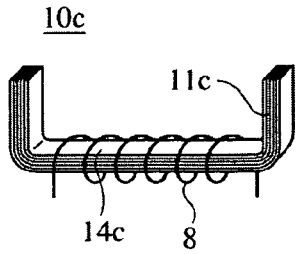
Figure 1D:
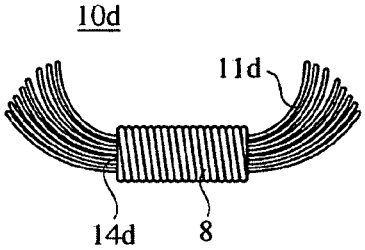
Figure 1E:
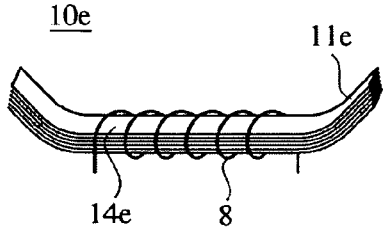
Figure 2A:
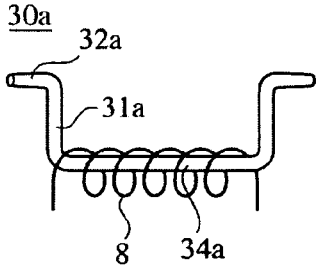
FIG. 2 is a schematic view showing another example of the antenna of the present invention.
Figure 2B:
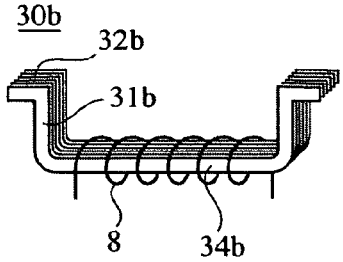
Figure 2C:
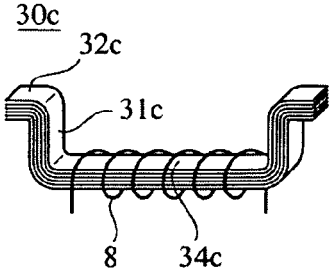
Figure 2D:
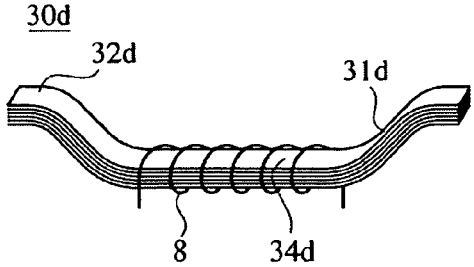
Figure 3A:
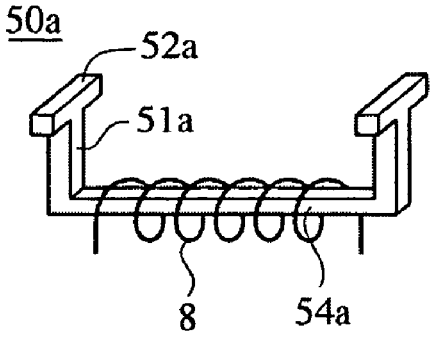
FIG. 3 is a schematic view showing a further example the antenna of the present invention.
Figure 3B:
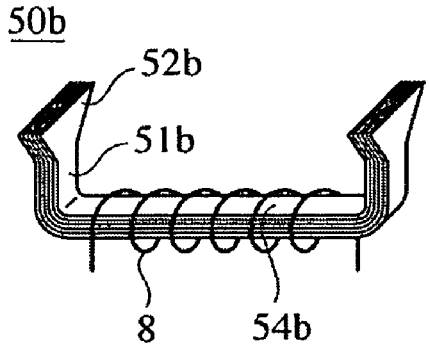
Figure 3C:
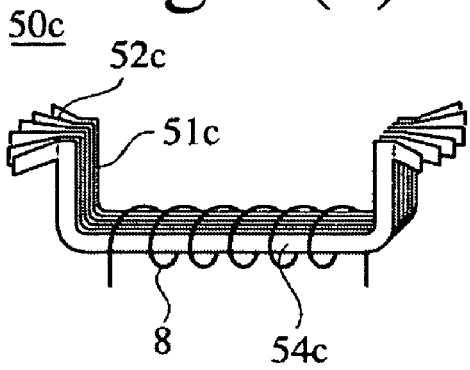
Figure 3D:
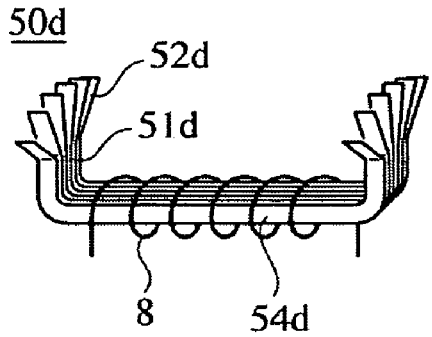
Figure 4A:
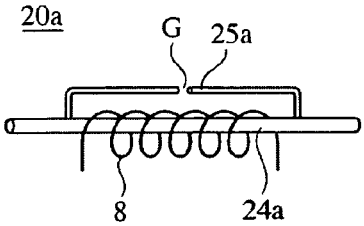
FIG. 4 is a schematic view showing a still further example of the antenna of the present invention.
Figure 4B:
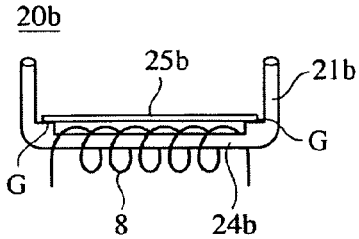
Figure 4C:
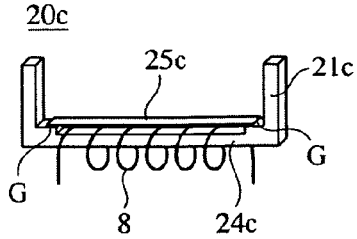
Figure 4D:
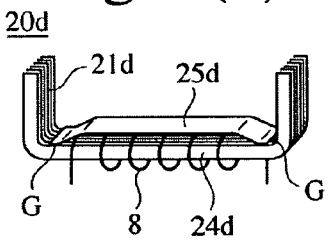
Figure 4E:
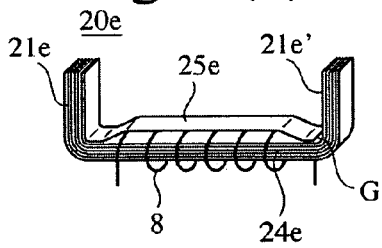
Figure 4F:
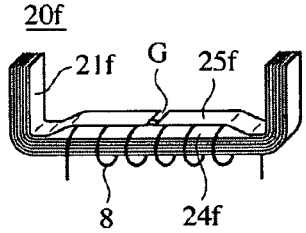
Figure 4G:
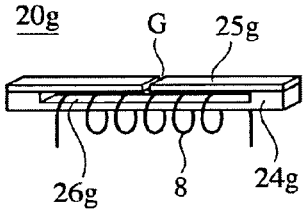
Figure 4H:
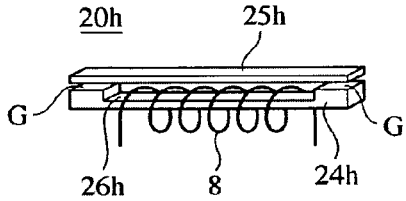
Figure 4I:
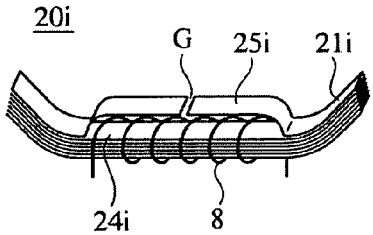
Figure 4J:
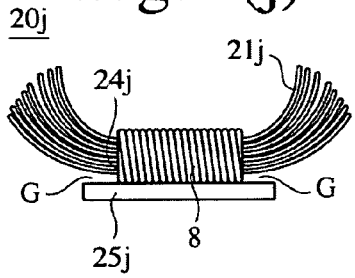
Figure 5A:
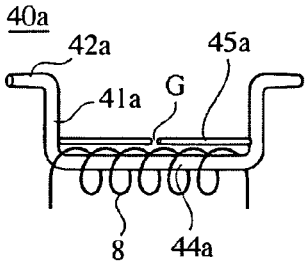
FIG. 5 is a schematic view showing a still further example of the antenna of the present invention.
Figure 5B:
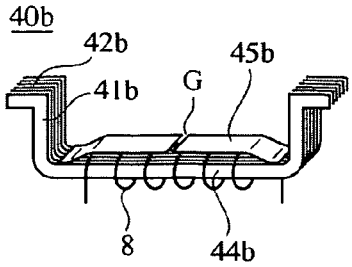
Figure 5C:
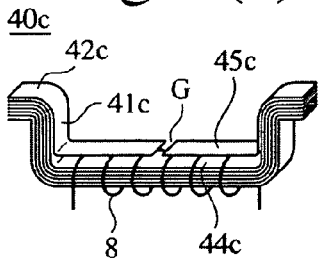
Figure 5D:
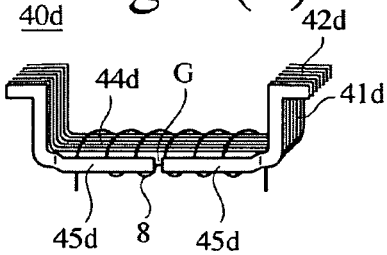
Figure 5E:
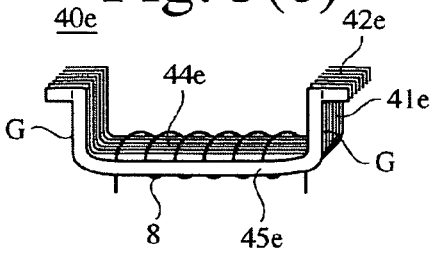
Figure 5F:
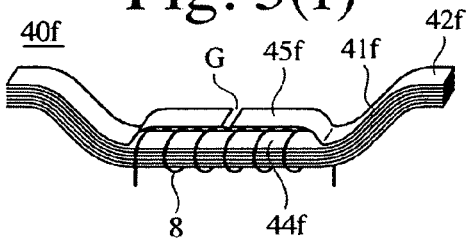
Figure 6A:
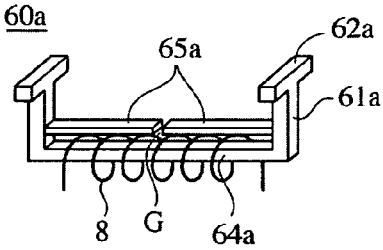
FIG. 6 is a schematic view showing a still further example of the antenna of the present invention.
Figure 6B:
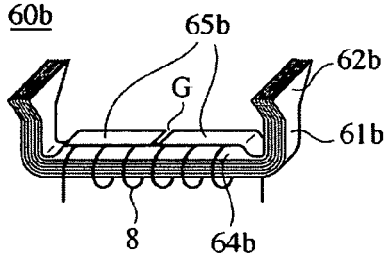
Figure 6C:
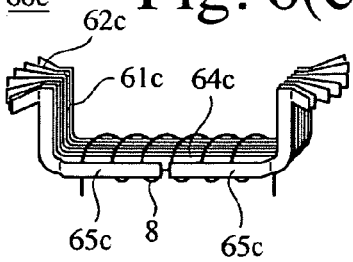
Figure 6D:
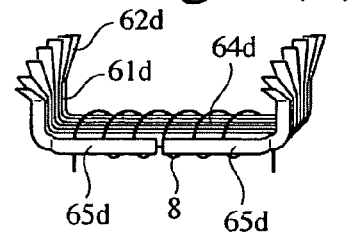

An antenna 10*a* shown in FIG. 1(*a*) comprises a ferrite rod 14*a*, and a coil 8 wound around the rod 14*a* in its center portion. Both end portions 11*a*, 11*a* of the rod 14*a* are bent perpendicularly to its center portion. Though not particularly restricted, a wire of the coil 8 preferably has a circular cross section from the aspect of productivity. Though both end portions 11*a*, 11*a* are bent in the antenna 10*a* shown in FIG. 1(*a*), the antenna of the present invention is not restricted to be bent in both end portions, but may be bent in only one end portion.

An antenna 10*b* shown in FIG. 1(*b*) comprises a laminate of thin sheets 14*b*, and a coil 8 wound around the laminate in its center portion. The thin sheet 14*b* is a metal foil of 20 μm or less in thickness integrally punched out in a U shape, which is made of an amorphous metal, etc. The antenna 10*b* comprising the laminate of the integrally punched-out thin sheets 14*b* has excellent mechanical strength. Punching is advantageous because it can produce any shape.

An insulating layer is preferably disposed between the thin sheets 14*b*. The insulating layer lowers eddy current generated in each thin sheet 14*b*, thereby suppressing loss. When the magnetic core is formed by a thin amorphous ribbon, etc., it is necessary to conduct a heat treatment at 350-450° C., preferably at 380-430° C., to improve magnetic properties. When the heat treatment temperature is lower than 350° C., sufficient magnetic properties cannot be obtained. The heat treatment at higher than 450° C. makes the thin ribbon too brittle, making it likely that the thin ribbon is broken when its end portions are bent, or when the housing drops. The heat treatment is carried out preferably in an inert atmosphere such as a nitrogen gas, etc.

An antenna 10*c* shown in FIG. 1(*c*) is the same as the antenna 10*b* shown in FIG. 1(*b*), except that it comprises a laminate of rectangular thin sheets 14*c* having both end portions 11*c*, 11*c* bent in a U shape. The bent magnetic core is made stronger by sandwiching the end portions or bent portions of the magnetic core by a case, or by applying a silicone adhesive or a vanish resin, etc. to its end portions.

An antenna 10*d* shown in FIG. 1(*d*) comprises a coil 8 wound around a center portion of a bundle of plural thin wires 14*d*. Each thin wire 14*d* is preferably coated with an insulating layer. The antenna 10*e* shown in FIG. 1(*e*) is substantially the same as the antenna 10*c* shown in FIG. 1(*c*), except for the bending angles of both end portions 11*e*, 11*e* of the thin sheets 14*e*. The end portions 11*e*, 11*e* are inclined to the center portion at about 45°. When the bending angle of the end portions 11*e*, 11*e* is less than 90°, the bent portions have relatively large strength, making it possible to use thin sheets 14*e* of such a brittle material as a heat-treated amorphous material, etc.

An antenna 30*a* shown in FIG. 2(*a*) is the same as the antenna 10*a* shown in FIG. 1(*a*), except that end portions 31*a*, 31*a* have outward bent tip end portions 32*a*, 32*a*. Accordingly, only differences will be explained below. The tip end portions 32*a*, 32*a* are in parallel with the center portion 34*a* of the magnetic core. Because the outward bent tip end portions 32*a*, 32*a* can catch a magnetic flux coming in various angles, the antenna 30*a* exhibits high sensitivity.

An antenna 30*b* shown in FIG. 2(*b*) is substantially the same as the antenna 10*b* shown in FIG. 1(*b*), except for the shape of punched thin sheets. Accordingly, only differences will be explained below. Each thin sheet is integrally punched out in a shape comprising a linear center portion 34*b*, end portions 31*b*, 31*b* perpendicular to the center portion 34*b*, and tip end portions 32*b*, 32*b* perpendicular to the end portions 31*b*, 31*b* and in parallel with the center portion 34*b*. The antenna 30*c* shown in FIG. 2(*c*) is substantially the same as the antenna 10*c* shown in FIG. 1(*c*), except that end portions 31*c*, 31*c* have outward bent tip end portions 32*c*, 32*c*. The tip end portions 32*c*, 32*c* are bent substantially perpendicularly to the end portions 31*c*, 31*c*, and in parallel with the center portion 34*c*. The antenna 30*d* shown in FIG. 2(*d*) is substantially the same as the antenna 10*e* shown in FIG. 1(*e*), except that end portions 31*d*, 31*d* have outward bent tip end portions 32*d*, 32*d*. The tip end portions 32*d*, 32*d* are bent substantially obtuse to the end portions 31*d*, 31*d*, and in parallel with the center portion 34*d*.

An antenna 50*a* shown in FIG. 3(*a*) is substantially the same as the antenna 10*a* shown in FIG. 1(*a*), except that end portions 51*a*, 51*a* are in a T shape. Accordingly, only differences will be explained below. Tip end portions 52*a*, 52*a* are at an angle of 90° to the center portion 54*a* of the magnetic core. The antenna 50*b* shown in FIG. 3(*b*) is substantially the same as the antenna 10*c* shown in FIG. 1(*c*), except that pluralities of thin sheets constituting a laminate have fan-shaped tip end portions 52*b*, 52*b*.

An antenna 50*c* shown in FIG. 3(*c*) is substantially the same as the antenna 30*b* shown in FIG. 2(*b*), except that pluralities of tip end portions 52*c*, 52*c* are radially bent. An antenna 50*d* shown in FIG. 3(*d*) is the same as the antenna 10*b* shown in FIG. 1(*b*), except that pluralities of tip end portions 52*d*, 52*d* are radially bent in directions of 90° to the center portion 54*d*.

Pluralities of branched tip end portions 52*c*, 52*d* can catch the incoming magnetic flux in a wide area. Though more branching catches more magnetic flux, design should be made to avoid the decrease of receiving sensitivity by the housing or a metal part in the housing. When the antenna is disposed in a metal housing or a housing having a metal part, at least one of the branched portions is directed away from the metal housing or a metal part in the housing. With the tip end portions 52*c*, 52*d* placed at an edge of the housing to spread along an inner wall of the housing, design can be made to fully use the inner space of the housing.

Figure 17:
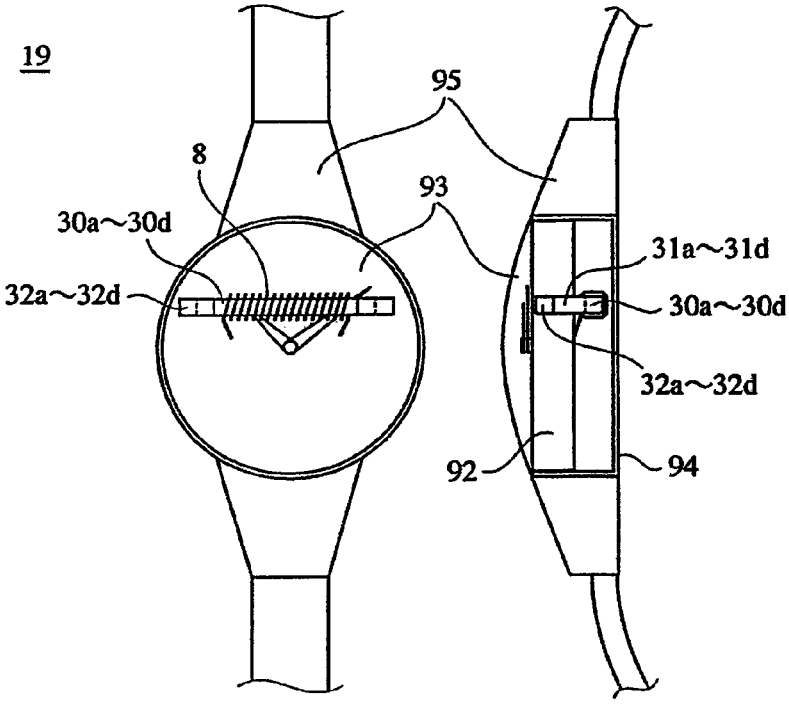
FIG. 17 is a view showing an example of the front and side of the radio-controlled wristwatch of the present invention.

FIG. 17 shows the front and side of a radio-controlled wristwatch 19 comprising any one of the antennas 30*a*-30*d*. In the front view, the antenna is depicted by a solid line to make clear its arrangement, etc. (the same is applicable below). The radio-controlled wristwatch 19 comprises a metal housing 95, a movement 92, a glass cover 93, a rear metal cover 94, and an antenna 30*a*, 30*b*, 30*c*, 30*d* (any one) disposed between the movement 92 and the rear cover 94. The antenna 30*a*, 30*b*, 30*c*, 30*d* is arranged such that its end portions 31*a*, 31*b*, 31*c*, 31*d* are uprising perpendicularly from the bottom surface. Though the center portion is surrounded by the metal housing 95, the end portions 31*a*, 31*b*, 31*c*, 31*d*, through which a magnetic flux flows, are directed toward the glass cover 93, so that the metal housing 95 does not hinder electromagnetic waves from being caught by the antenna. Because the tip end portions 32*a*, 32*b*, 32*c*, 32*d* are outward bent near the glass cover 93, radio waves easily flow into them.

An antenna having a magnetic sub-path member will be explained referring to the drawings. An antenna 20*a* shown in FIG. 4(*a*) comprises a rod-shaped magnetic core 24*a* made of ferrite, a coil 8 wound around the magnetic core 24*a*, and L-shaped, magnetic sub-path members 25*a*, 25*a* attached to the magnetic core 24*a*. The magnetic sub-path members 25*a*, 25*a* are attached to the magnetic core 24*a*, such that their longer portions are in parallel with the magnetic core 24*a* with a gap G between their ends. The magnetic sub-path member 25*a* need only be made of a magnetic material, preferably such as manganese ferrite, nickel ferrite, or cobalt-based amorphous alloys.

The gap G is preferably 0.025-3 mm, more preferably 0.1-2 mm. When the gap G is less than 0.025 mm, the magnetic sub-path members 25*a*, 25*a* have too small resistance to receive the incoming magnetic flux. When it exceeds 3 mm, the magnetic sub-path members 25*a*, 25*a* have undesirably large resistance to keep current flowing. When there is one gap G like in this embodiment, it is particularly preferably 0.2-2 mm, practically about 1 mm.

In the antenna 20*a* having the magnetic sub-path members 25*a*, 25*a*, part of the incoming magnetic flux flows into a main magnetic circuit (magnetic core 24*a*) via the magnetic sub-path members 25*a*, 25*a*, resulting in an effectively large amount of a magnetic flux passing through the coil 8. Each magnetic sub-path member 25*a*, 25*a* preferably has a smaller cross section area than that of the magnetic core 24*a*. A cross section area ratio of the magnetic sub-path member 25*a* to the magnetic core 24*a* is preferably 1/10000-2, more preferably 1/1000-1/2, particularly 1/100-1/5. With the cross section area ratio within this range, the magnetic sub-path members and the magnetic core 24*a*, a main circuit, exhibit their functions clearly, resulting in a larger amount of a magnetic flux passing through the coil 8.

When the antenna 20*a* is placed in the metal housing, the end portions of the magnetic core 24*a* and/or the end portions of the magnetic sub-path members 25*a*, 25*a* should be directed away from the metal housing. When part of the housing is made of a metal, the end portions of the magnetic core 24*a* and/or the end portions of the magnetic sub-path members 25*a*, 25*a* are directed away from the metal part. For instance, when the antenna is installed in a radio-controlled wristwatch, it is preferably directed toward a glass cover. With the end portions of the magnetic core 24*a* and/or the end portions of the magnetic sub-path members 25*a*, 25*a* directed toward the incoming magnetic flux, a lot of magnetic flux can be gathered, thereby providing the antenna with high sensitivity. Because a magnetic flux generated by a resonance current generated by the coil 8 and a capacitor connected in parallel to the coil 8 flows mainly into and out of both end portions of the magnetic core 24*a*, the orientation of the end portions of the magnetic core 24*a* away from the metal housing reduces the amount of a magnetic flux passing through the metal housing. As a result, less eddy current is generated in the metal housing, resulting in a higher electric Q value and a higher sensitivity of the antenna.

The Q value is defined as ωL/R, wherein ω represents the angular frequency of a radio wave, R represents the resistance of a resonance circuit constituted by the antenna 20*a* and a capacitor, and L is the self-inductance of the coil 8. R is a sum of the DC resistance and AC resistance of the coil 8. When the antenna 20*a* is disposed in the metal housing, the antenna 20*a* has an increased AC resistance, because a resonance voltage as large as Q times the applied voltage is generated at both ends of the coil 8 due to the resonance occurring in the magnetic core 24*a* by the coil 8 and the capacitor, thereby generating a magnetic flux near both ends of the antenna 20*a*. When a magnetic flux generated by resonance passes through the metal housing, an eddy current loss occurs. The magnetic flux enters one end of the magnetic core 24*a* and exits from the other end thereof via the coil 8. In the antenna 20*a* having the magnetic sub-path members 25*a*, 25*a*, however, part of the magnetic flux returns to the magnetic sub-path members 25*a*, 25*a* and passes the coil 8 again. As a result, a substantially large voltage is generated. A magnetic flux generated by a resonance current returns to the magnetic core 24*a* via the magnetic sub-path members 25*a*, 25*a*, so that the total amount of a magnetic flux radiated from both ends of the antenna 20*a* can be reduced. When the antenna 20*a* is placed in the metal housing, too, a smaller amount of a magnetic flux passes through the metal, thereby suppressing increase in AC resistance. Thus, increase in the resistance R is minimized, resulting in an increased Q value and thus a reduced loss by eddy current, etc.

An antenna 20*b* shown in FIG. 4(*b*) is the same as the antenna 10*a* shown in FIG. 1(*a*), except that a magnetic sub-path member 25*b* is disposed inside a U-shaped magnetic core 24*b*. Accordingly, only differences will be explained below. The magnetic core 24*b* has a step in each bent portion, and the rod-shaped, magnetic sub-path member 25*b* engages the steps. The steps function as the stopper of a winding, too. The magnetic sub-path member 25*b* is preferably made of ferrite, etc. There are gaps G, G between both ends of the magnetic sub-path member 25*b* and the end portions 21*b*, 21*b*. In the case of having two gaps G, G, each gap G is preferably 0.1-1 mm, practically about 0.5 mm.

An antenna 20*c* shown in FIG. 4(*c*) is substantially the same as the antenna 20*b* shown in FIG. 4(*b*) except for having a magnetic core 24*c* having a rectangular cross section. Accordingly, only differences will be explained below. Because a magnetic sub-path member 25*c* is also a rectangular, thin sheet or ribbon, it has large contact areas with a pair of steps. The antenna 20*c* comprising the rectangular-cross-sectioned magnetic core 24*c* and the magnetic sub-path member 25*c* is well fit in a housing.

An antenna 20*d* shown in FIG. 4(*d*) is substantially the same as the antenna 10*b* shown in FIG. 1(*b*), except that a ribbon-shaped, magnetic sub-path member 25*d* is attached to an inside surface of a U-shaped magnetic core 24*d*. Accordingly, only differences will be explained below. The magnetic sub-path member 25*d* is attached to the magnetic core 24*d* via an intermediate member (for instance, film) of a resin such as PET, etc., covering part of the coil 8. Accordingly, there are magnetic gaps G, G between the magnetic sub-path member 25*d* and the magnetic core 24*d*. The magnetic sub-path member 25*d* is preferably formed by an amorphous foil of the same material as that of the magnetic core 24*d*. Thus, the term "gap G" used herein includes, in addition to a physically vacant air gap, a magnetically isolated mass (magnetic gap G), which is physically filled, but does not permit or makes it extremely difficult for a magnetic flux to flow.

An antenna 20*e* shown in FIG. 4(*e*) is substantially the same as the antenna 10*c* shown in FIG. 1(*c*), except that a ribbon-shaped, magnetic sub-path member 25*e* is mounted to an inside surface of a U-shaped magnetic core 24*e*. Accordingly, only differences will be explained below. One end portion of the magnetic sub-path member 25*e* extends along one end portion 21*e* of the magnetic core 24*e*, and there is a gap G only on the side of the other end portion 21*e'*.

An antenna 20*f* shown in FIG. 4(*f*) is substantially the same as the antenna 20*e* shown in FIG. 4(*e*), except that a pair of magnetic sub-path members 25*f*, 25*f* are fixed to end portions 21*f*, 21*f*, respectively. Accordingly, only differences will be explained below. The magnetic sub-path members 25*f*, 25*f* are attached to the inside surfaces of end portions 21*f*, 21*f*, such that there is a gap G between both ends of the sub-path members 25*f*, 25*f*.

An antenna 20*g* shown in FIG. 4(*g*) comprises a sheet-shaped, magnetic core 24*g* made of ferrite and having a recess 26*g*, a coil 8 wound around the magnetic core 24*g*, and magnetic sub-path members 25*g*, 25*g* mounted to end portions of the magnetic core 24*g*. There is a gap G between the ends of the magnetic sub-path members 25*g*, 25*g*. The magnetic sub-path members 25*g*, 25*g* are preferably made of ferrite.

An antenna 20*h* shown in FIG. 4(*h*) is substantially the same as the antenna 20*g* shown in FIG. 4(*g*), except that one magnetic sub-path member 25*h* is attached to both end portions of the magnetic core 24*h* via an intermediate member (not shown). Accordingly, only differences will be explained below. Because the intermediate member sandwiched by the magnetic sub-path member 25*h* and the magnetic core 24*h* is made of a resin, there is a magnetic gap G between the magnetic sub-path member 25*h* and the magnetic core 24*h*. The size of the gap G can be controlled by the thickness of the intermediate member.

Because each antenna 20*g*, 20*h* comprises a sheet-shaped magnetic core 24*g*, 24*h*, onto which a sheet-shaped magnetic sub-path member 25*g*, 25*h* is attached, it is easily produced and installed in a small area. When the magnetic sub-path members 25*g*, 25*h* are made of composites of resins and magnetic materials, etc., the composites per se have the same magnetic properties as having a gap G. Accordingly, even if there is no mechanical gap, it may be regarded that there is magnetically a gap G. This makes it possible to have a gap G without using an intermediate member.

An antenna 20*i* shown in FIG. 4(*i*) is substantially the same as the antenna 10*e* shown in FIG. 1(*e*), except that a pair of magnetic sub-path members 25*i*, 25*i* are attached to an inside surface of a magnetic core 24*i* bent at an obtuse angle. Accordingly, only differences will be explained below. Ribbon-shaped, magnetic sub-path members 25*i*, 25*i* are attached to an inside surface of each end portion 211, 211 of the magnetic core 24*i*. The magnetic sub-path members 25*i*, 25*i* are bent such that they bulge over a coil 8. There is a gap G between the ends of the magnetic sub-path members 25*i*, 25*i*.

An antenna 20*j* shown in FIG. 4(*j*) is substantially the same as the antenna 10*d* shown in FIG. 1(*d*), except that a sheet-shaped, magnetic sub-path member 25*j* is attached to a coil 8. Accordingly, only differences will be explained below. Because the magnetic sub-path member 25*j* is attached to a side surface of the coil 8, there is substantially a gap G corresponding to the thickness of the coil between the magnetic core 24*j* and the magnetic sub-path member 25*j*.

In the antenna 20 comprising a magnetic sub-path member 25, not only the incoming magnetic flux passes through the magnetic core 21, around which the coil 8 is wound, but also part of the magnetic flux passes through the magnetic sub-path member 25 to return to the magnetic core 21, circulating in a main magnetic circuit. Accordingly, the incoming magnetic flux is divided to a main magnetic circuit and another closed magnetic circuit and efficiently circulated, resulting in a high output voltage.

An antenna 40*a* shown in FIG. 5(*a*) is substantially the same as the antenna 30*a* shown in FIG. 2(*a*), except that rod-shaped, magnetic sub-path members 45*a*, 45*a* are supported like cantilevers inside a substantially U-shaped magnetic core 44*a*. Accordingly, only differences will be explained below. The rear ends of the magnetic sub-path members 45*a*, 45*a* are perpendicularly attached to the inside surfaces of the end portions 41*a*, 41*a* of the magnetic core 44*a*. There is a gap G between the ends of the magnetic sub-path members 45*a*, 45*a*.

An antenna 40*b* shown in FIG. 5(*b*) is substantially the same as the antenna 30*b* shown in FIG. 2(*b*), except that ribbon-shaped, magnetic sub-path members 45*b*, 45*b* are attached to inside surfaces of a substantially U-shaped magnetic core 44*b*. Accordingly, only differences will be explained below. The ribbon-shaped, magnetic sub-path members 45*b*, 45*b* are bent such that they bulge over a coil 8, and there is a gap G between their ends.

An antenna 40*c* shown in FIG. 5(*c*) is substantially the same as the antenna 30*c* shown in FIG. 2(*c*), except that sheet-shaped, magnetic sub-path members 45*c*, 45*c* are attached to inside surfaces of a substantially U-shaped magnetic core 44*c*. Accordingly, only differences will be explained below. The rear end portions of the magnetic sub-path members 45*c*, 45*c* are attached to the end portions 41*c*, 42*c* of the magnetic core 44*c*, and their tip portions are bent to be substantially parallel to the center portion of the magnetic core 44*c*. There is a gap G between the ends of the magnetic sub-path members 45*c*, 45*c*.

An antenna 40*d* shown in FIG. 5(*d*) is substantially the same as the antenna 30*b* shown in FIG. 2(*b*), except for having magnetic sub-path members 45*d*, 45*d* attached to a side surface of a magnetic core 44*d*. Accordingly, only differences will be explained below. Rear end portions of the magnetic sub-path members 45*d*, 45*d* are attached to the side surfaces of end portions 41*d*, 41*d* of the magnetic core 44*d*. There is a gap G between the ends of both magnetic sub-path members 45*d*, 45*d*.

An antenna 40*e* shown in FIG. 5(*e*) comprises one magnetic sub-path member 45*e* attached to a side surface of a magnetic core 44*e*. Tip end portions of the magnetic sub-path member 45*e* are attached to tip end portions 42*e*, 42*e* of the magnetic core 44*e*, and the magnetic sub-path member 45*e* is bent such that there are gaps G between the magnetic sub-path member 45*e* and the end portions 41*e*, 41*e* of the magnetic core 44*e*.

An antenna 40*f* shown in FIG. 5(*f*) is substantially the same as the antenna 40*c* shown in FIG. 5(*c*), except for a bending angle of end portions 41*f*, 41*f*. The end portions 41*f*, 41*f* of the antenna 40*f* are bent at an angle of about 45° to the center portion 44*f*. Tip end portions of 42*f*, 42*f* are substantially in parallel with the center portion 44*f*.

An antenna 60*a* shown in FIG. 6(*a*) is substantially the same as the antenna 50*a* shown in FIG. 3(*a*), except that sheet-shaped, magnetic sub-path members 65*a*, 65*a* are attached like cantilevers to end portions 61*a*, 61*a*. Accordingly, only differences will be explained below. The magnetic sub-path members 65*a*, 65*a* are supported at rear ends by the end portions 61*a*, 61*a*, such that there is a gap G between their ends.

An antenna 60*b* shown in FIG. 6(*b*) is substantially the same as the antenna 50*b* shown in FIG. 3(*b*), except that thin, ribbon-shaped, magnetic sub-path members 65*b*, 65*b* are attached to inside surfaces of end portions 61*b*, 61*b*. Accordingly, only differences will be explained below. The magnetic sub-path members 65*b*, 65*b* are bent such that they bulge over a coil. There is a gap G between the ends of the magnetic sub-path members 65*b*, 65*b*.

An antenna 60*c* shown in FIG. 6(*c*) is substantially the same as the antenna 50*c* shown in FIG. 3(*c*), except that thin, sheet-shaped, magnetic sub-path members 65*c*, 65*c* are attached to a side surface of a magnetic core 64*c*.

An antenna 60*d* shown in FIG. 6(*d*) is substantially the same as the antenna 50*d* shown in FIG. 3(*d*), except that thin, sheet-shaped, magnetic sub-path members 65*d*, 65*d* are attached to a side surface of a magnetic core 64*d*.

Figure 7A:
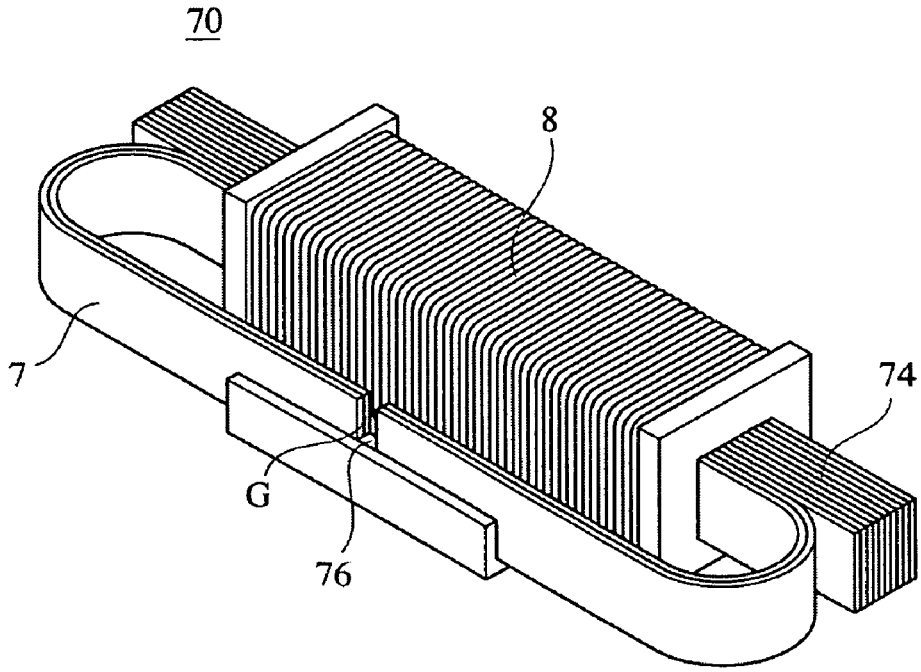
FIG. 7 is a perspective view showing a still further example of the antenna of the present invention.
Figure 7B:
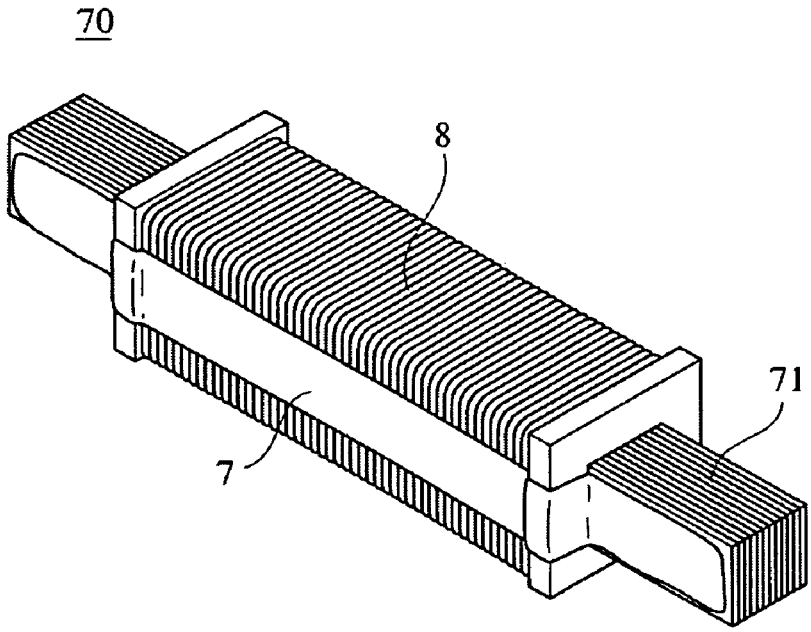

FIG. 7(*a*) shows an antenna comprising a magnetic core 74 constituted by a thin ribbon laminate, a coil 8 wound around the magnetic core 74, and a magnetic sub-path member 7 penetrating the coil 8 and longitudinally circulating by substantially one turn. The magnetic sub-path member 7 is constituted by a thin ribbon laminated to the magnetic core 74, and penetrates the coil 8 together with the magnetic core 74. Ends of the magnetic sub-path member 7 are opposing with a gap G on a side surface of the coil 8 at around a center. The gap G is as wide as 0.025-3 mm. To keep a constant width, the gap G is filled with a resin 76. Though most of the magnetic flux enters the magnetic core 74 from one end and flows toward the other end, part of the magnetic flux enters the magnetic sub-path member 7 and returns to the magnetic core 74. Accordingly, the magnetic flux passes through the coil 8 in a large amount, resulting in high sensitivity.

The antenna shown in FIG. 7(*b*) is substantially the same as shown in FIG. 7(*a*), except that a ribbon-shaped coating is formed on the magnetic core 74 from one end to the other to longitudinally cover part of the coil 8. The coating made of a soft magnetic material constitutes a magnetic sub-path member 7. The coating preferably contains magnetic powder and is formed by applying a viscous paint. Instead of applying the paint, a coating having a predetermined specific permeability may be formed by plating, etc.

Figure 8A:
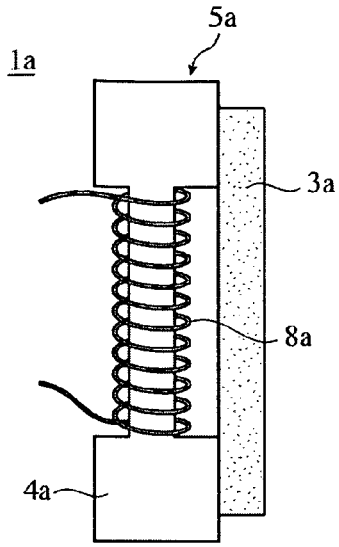
FIG. 8 is a schematic view showing a still further example of the antenna of the present invention.
Figure 8B:
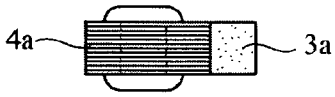

A magnetic sensor-type antenna 1*a* shown in FIGS. 8(*a*) and 8(*b*) comprises a barbell-shaped magnetic core 4*a*, a coil 8*a* wound around it, and a magnetic sub-path member 3*a* connected to both end portions of the magnetic core 4*a*. In FIGS. 8(*a*) and 8(*b*), a case such as a bobbin, etc. is omitted for the clarity of explanation. The magnetic core 4*a* having the coil 8*a* constitutes a magnetic main path member 5*a*. The magnetic sub-path member 3*a* constitutes a closed magnetic path with the magnetic main path member 5*a*. The magnetic core 4*a* is produced by laminating 30-40 thin ribbons via insulators. The thin ribbon is preferably made of a soft magnetic material having a permeability of about 100-300,000. Specific examples of the soft magnetic material include soft magnetic metals such as amorphous alloys, Fe—Si magnetic alloys, etc., silicon steel, Parmalloy, nanocrystalline metals of Fe—Cu—Nb—Si—B, ferrite, etc. The permeability of the magnetic core 4*a* is more preferably 500-100,000.

The coil 8*a* is wound around a center portion of the magnetic core 4*a* in about 800-1400 turns. The magnetic sub-path member 3*a* is attached to the magnetic core 4*a* without an air gap. The specific permeability of the magnetic sub-path member 3*a* is less than that of the magnetic main path member 5*a*, preferably 5-100. When the specific permeability of the magnetic sub-path member 3*a* is 100 or less, most of the magnetic flux generated by a resonance current passes through the magnetic main path member 5*a*, so that the coil suffers less reduction of the Q value, resulting in high sensitivity. When the specific permeability is higher than 100, the magnetic flux passes more through the magnetic sub-path member 3*a*, resulting in lower voltage induced by the coil, and thus likelihood of reduced sensitivity. When the specific permeability is less than 5, the magnetic flux scarcely circulates the magnetic sub-path member 3*a*, so that the magnetic sub-path member 3*a* fails to fully exhibit its own function. The flowability of the magnetic flux depends on the permeability and cross section area of the magnetic sub-path member 3*a* and, and its area opposing the magnetic main path member 5*a*. The adjustment of the permeability and cross section area of the magnetic sub-path member 3*a* and its area opposing the magnetic main path member 5*a* is much easier than the adjustment of an air gap provided in the magnetic sub-path member 3*a*, thereby making the working extremely easier.

Figure 9A:
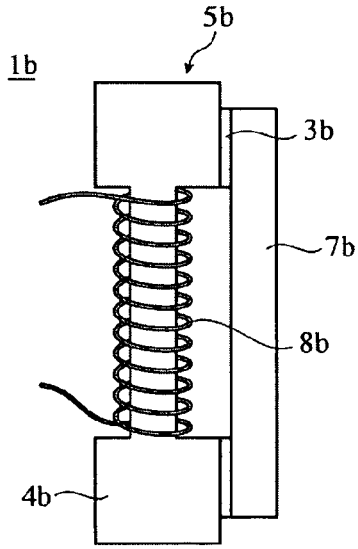
FIG. 9 is a schematic view showing a still further example of the antenna of the present invention.
Figure 9B:
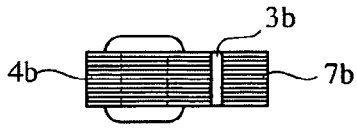

A magnetic sensor-type antenna 1*b* shown in FIGS. 9(*a*) and 9(*b*) is substantially the same as shown in FIGS. 8(*a*) and 8(*b*), except that a magnetic sub-path member is constituted by a first rod-shaped, magnetic sub-path member 7*b*, and a second magnetic sub-path member 3*b* sandwiched by the first magnetic sub-path member 7*b* and the magnetic main path member 5*b*. Accordingly, only differences will be explained below. Without air gaps on both ends of the second magnetic sub-path members 3*b*, the magnetic main path member 5*b* and the first and second magnetic sub-path members 7*b*, 3*b* constitute a closed magnetic path. Both of the magnetic main path member 5*b* and the first magnetic sub-path member 7*b* are laminates, and the first magnetic sub-path member 7*b* is attached to the second magnetic sub-path member 3*b* in parallel with the lamination direction.

Figure 12:
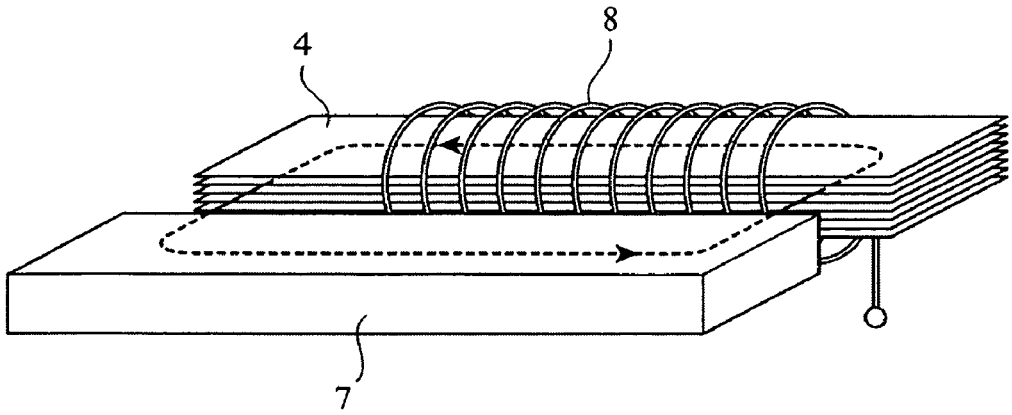
FIG. 12 is a schematic view showing the relation between a magnetic flux and eddy current.
Figure 13:
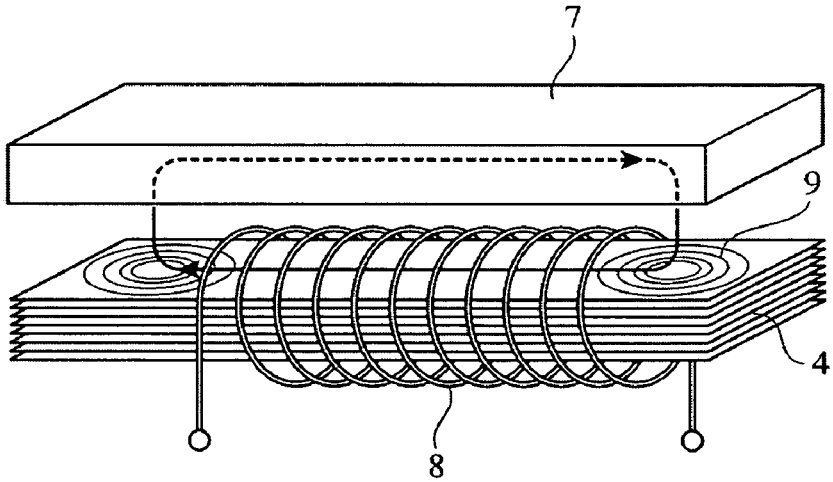
FIG. 13 is a reference view schematically showing the relation between a magnetic flux and eddy current.
Figure 14A:
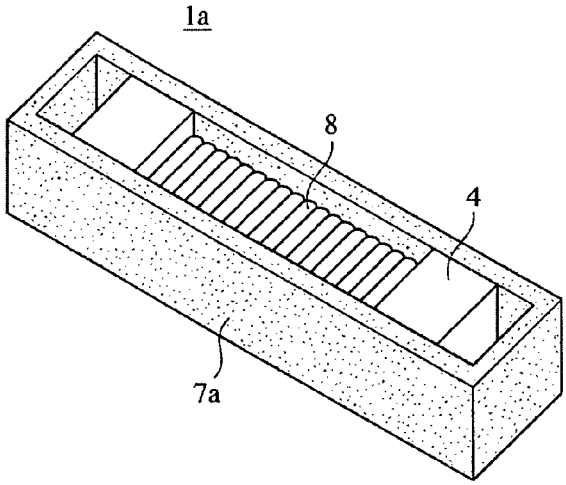
FIG. 14 is a perspective view showing an example of an antenna comprising a case functioning as a magnetic sub-path member.
Figure 14B:
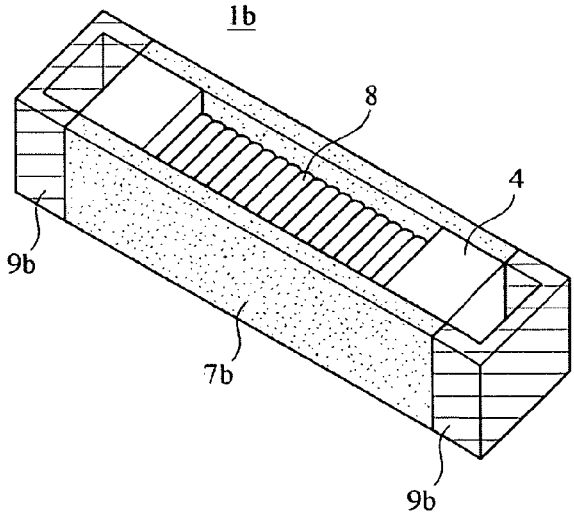
Figure 14C:
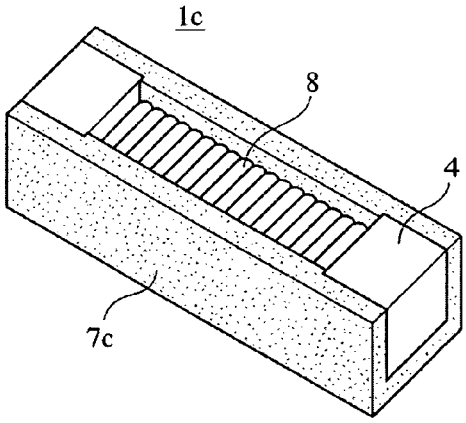
Figure 14D:
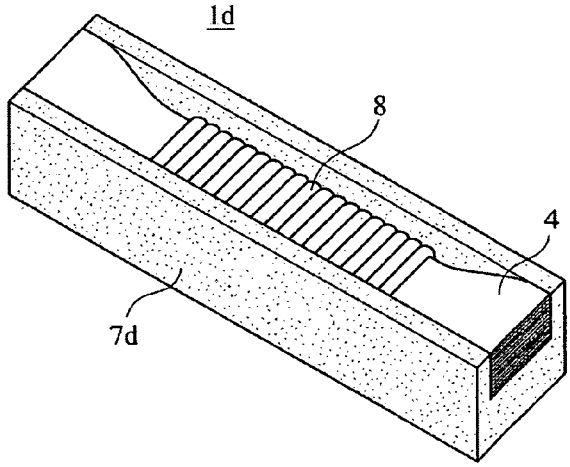
Figure 15E:
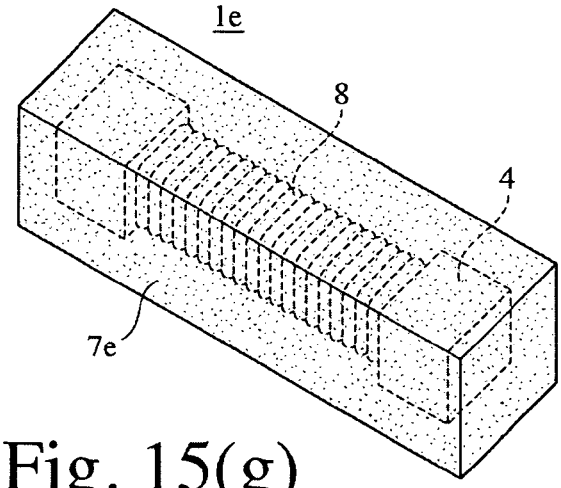
FIG. 15 is a perspective view showing an example of an antenna comprising an injection-molded case.
Figure 15F:
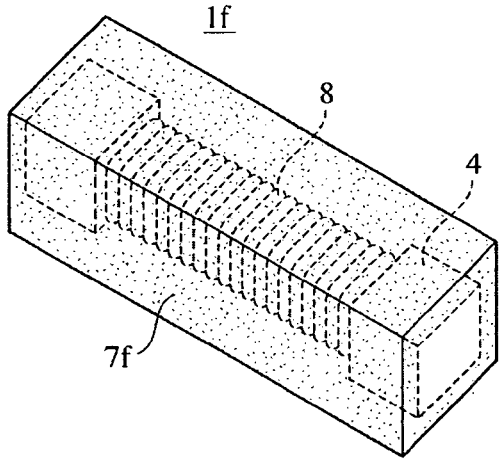
Figure 15G:
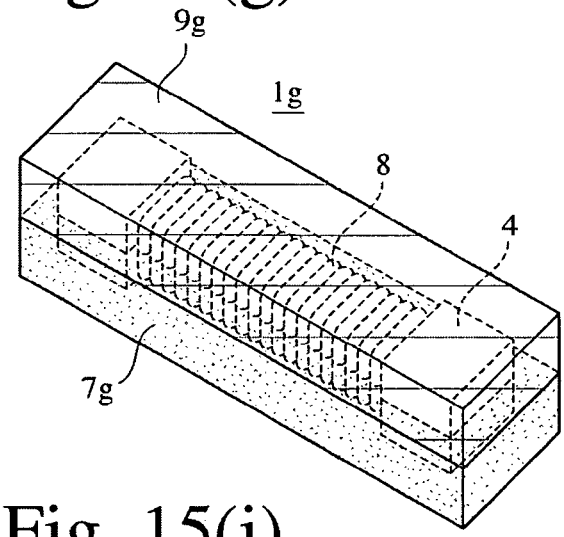
Figure 15H:
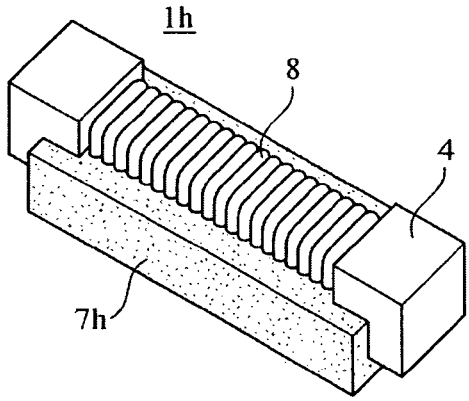
Figure 15I:
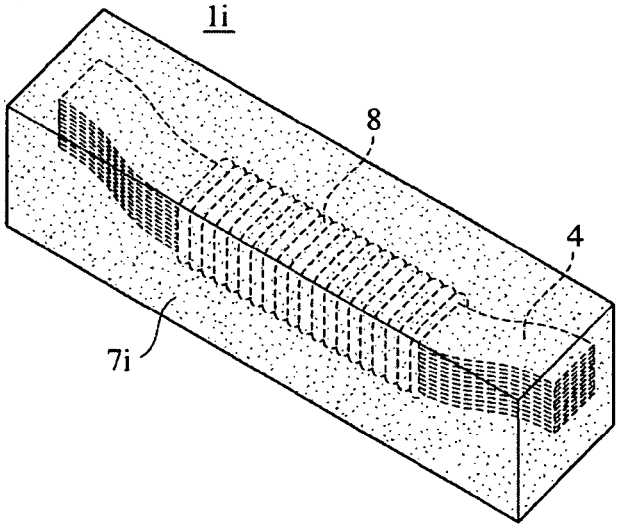

With the magnetic main path member 5*b* and the first magnetic sub-path member 7*b* having parallel lamination directions, an eddy current is suppressed. This reason will be explained referring to FIGS. 12 and 13. For instance, when the magnetic sub-path member 7 is arranged in parallel with the thin ribbons of the magnetic core 4 as shown in FIG. 13, a magnetic flux flows in a direction penetrating the sheets of the magnetic core 4. Accordingly, large eddy current 9 is generated in the magnetic core 4, resulting in a large loss and a reduced Q value. In the arrangement shown in FIG. 12, however, the magnetic flux 8 passes through the magnetic core 4 perpendicularly to its laminate direction and enters the magnetic sub-path member 7. In this case, no magnetic flux needs to enter the thin ribbons constituting the magnetic core 4 perpendicularly to their surfaces, resulting in less generation of eddy current and loss. Of course, the lamination direction of the magnetic sub-path member 7 is also preferably set such that the magnetic flux 8 does not pass through the laminated thin ribbons of the magnetic sub-path member 7.

The first magnetic sub-path member 7*b*, in FIGS. 9(*a*) and 9(*b*), has permeability equal to or lower than that of the magnetic core 4*b*. The second magnetic sub-path member 3*b* has lower permeability than that of the first magnetic sub-path member 7*b*. When the permeability of the second magnetic sub-path member 3*b* is lower than that of the first magnetic sub-path member 7*b*, a large amount of a magnetic flux returns to the magnetic main path member 5*b* even when the first magnetic sub-path member 7*b* has relatively high permeability, resulting in a small eddy current loss.

The magnetic main path member 5*b* and the first magnetic sub-path member 7*b* may be formed not only by thin ribbons, but also by rods, sheets or wires. Materials for the magnetic main path member 5*b* and the first and second magnetic sub-path members 7*b*, 3*b* may be, in addition to metals, ferrites, amorphous alloys and nanocrystalline materials, soft composites comprising magnetic powder such as ferrite powder and amorphous alloy powder dispersed in flexible polymers (resins or rubbers) for having an electromagnetic wave-absorbing function.

Though not particularly restricted, the first and second magnetic sub-path members 7*b*, 3*b* may preferably have such a structure as comprising an electromagnetic wave-reflecting layer having conductive fibers dispersed in a flexible polymer, first electromagnetic wave-absorbing layers having flat magnetic metal powder dispersed in a flexible polymer, and second electromagnetic wave-absorbing layers having granular magnetic metal powder dispersed in a flexible polymer, the first and second electromagnetic wave-absorbing layers being thermally press-bonded in this order to both surfaces of the electromagnetic wave-reflecting layer. Alternatively, they may comprise either one of the first and second electromagnetic wave-absorbing layers.

The electromagnetic wave-reflecting layer is preferably, for instance, a sheet formed by dispersing carbon fibers or metal fibers in a flexible polymer. The magnetic metal powder is preferably flat powder obtained by disintegrating granular powder produced by a water atomization method from nanocrystalline magnetic alloys such as Fe—Cu—Nb—Si—B, etc. The flat powder preferably has an average particle size of 0.1-50 μm and an average thickness of about 1-5 μm. To provide a preferred electromagnetic wave-absorbing layer, this flat powder is preferably dispersed in a flexible polymer and formed into a sheet. Flat magnetic metal powders of carbonyl iron alloys, amorphous alloys, Fe—Si alloys, molybdenum Parmalloy, Supermalloy, etc. may also be used for the electromagnetic wave-absorbing layer. The flexible polymer is preferably soft and has a specific gravity of 1.5 or less and weathering resistance. Specifically, chloroprene rubbers, butyl rubbers, urethane rubbers, silicone resins, vinyl chloride resins, phenol resins, etc. are usable.

The use of such a soft composite provides a magnetic gap despite no physical gap. Accordingly, the first and second magnetic sub-path members 7*b*, 3*b* made of the soft composite can return a magnetic flux to a closed magnetic path without an air gap, whose adjustment is difficult.

When the magnetic main path member 5*b* is contained in a resin case, the first and second magnetic sub-path members 7*b*, 3*b* are preferably contained in the same case. A molten soft composite may be injection-molded into a hollow portion of the resin case, to integrally mold the first and second magnetic sub-path members 7*b*, 3*b*. Also, a soft composite can be injected into a gap between the magnetic main path member 5*b* and the first magnetic sub-path member 7*b* contained in the resin case, to mold the second magnetic sub-path member 3*b* integrally with other members. Such methods produce the antenna inexpensively.

Figure 10A:
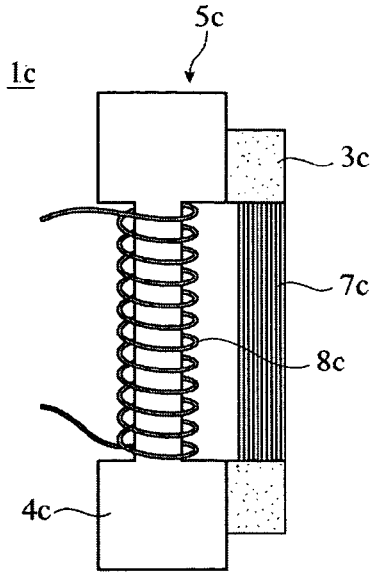
FIG. 10 is a schematic view showing a still further example of the antenna of the present invention.
Figure 10B:
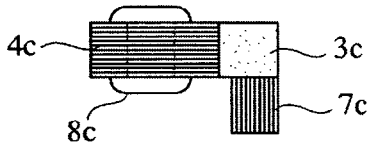

A magnetic sensor-type antenna 1*c* shown in FIGS. 10(*a*) and 10(*b*) is substantially the same as shown in FIGS. 9(*a*) and 9(*b*), except for the shape of a second magnetic sub-path member 3*c* connecting a first magnetic sub-path member 7*c* to a magnetic main path member 5*c*. Accordingly, only differences will be explained below. The second magnetic sub-path member 3*c* in a rectangular prism shape has one surface bonded to the magnetic main path member 5*c*, and an adjacent surface bonded to the first magnetic sub-path member 7*c*. The first magnetic sub-path member 7*c* has a lamination direction perpendicular to that of the magnetic main path member 5*c*. Though different lamination directions of the first magnetic sub-path member 7 and the magnetic main path member 5*c* tend to generate eddy current, the eddy current is suppressed to some extent in this antenna 1*c*, because the axis of the magnetic core 4*c* is deviated from that of the first magnetic sub-path member 7*c* in a depth direction in the front view.

Figure 11A:
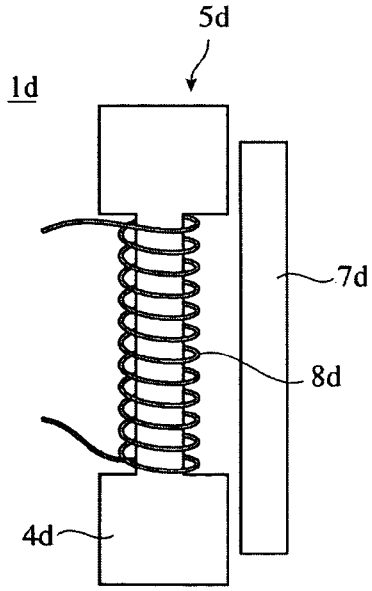
FIG. 11 is a schematic view showing a still further example of the antenna of the present invention.
Figure 11B:
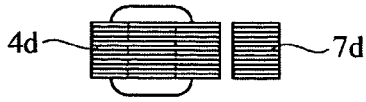

A magnetic sensor-type antenna 1*d* shown in FIGS. 11(*a*) and 11(*b*) is substantially the same as the magnetic sensor-type antenna 1*a* shown in FIGS. 8(*a*) and 8(*b*), except that there are air gaps between the magnetic main path member 5*d* and the magnetic sub-path member 7*d*. Accordingly, only differences will be explained below. The magnetic main path member 5*d* and the magnetic sub-path member 7*d* are fixed by a bobbin (not shown). Both magnetic main path member 5*d* and magnetic sub-path member 7*d* are laminates with parallel lamination directions, resulting in less likelihood of generating eddy current.

An antenna shown in FIG. 14(*a*) comprises a case 7*a*, a magnetic core 4 contained in the case 7*a*, and a coil 8 wound around the magnetic core 4. The case 7*a*, which is made of a soft magnetic material and in contact with the end portions of the magnetic core 4, functions as a magnetic sub-path member, too. Namely, the case 7*a* not only has a function to protect a brittle magnetic core 4, but also forms a magnetic circuit with the magnetic core 4 for causing part of a magnetic flux to enter and return to the magnetic core 4, thereby exhibiting a function to increase the amount of a magnetic flux flowing through the coil 8. The case 7*a* also prevents a magnetic flux from leaking outside from the magnetic core 4. A cross section area ratio of the case 7*a* to the magnetic core 4 is preferably 1/1000-1/2, more preferably 1/100-1/5.

The case 7*a* is preferably made of a composite of soft magnetic ferrite or soft magnetic powder or flake, and a plastic polymer such as a resin or a rubber, etc. The specific permeability of the case 7*a* is smaller than that of the magnetic core 4, preferably 5-100, more preferably 10-60. When the specific permeability is more than 100, it is difficult to concentrate a magnetic flux in the magnetic main path member. When the case 7*a* is made by a composite, a proper specific permeability can be achieved by controlling a ratio of soft magnetic powder to a resin, etc., and the thickness of the case 7*a* can be easily changed. The composite is also easily worked because of softness. If the magnetic sub-path member is difficult to assemble, the case 7*a* (magnetic sub-path member) may be formed by applying a viscous paint containing soft magnetic powder such as soft magnetic ferrite powder, etc. to the magnetic main path member.

Though it is unexpectedly difficult to attach the magnetic sub-path member to a small, brittle antenna in a practical assembling, the use of a case made of a soft magnetic material can easily exhibit a function as a magnetic sub-path member only by its contact with the end portions of the magnetic core 4. Accordingly, a high-sensitivity antenna can be obtained without needing the positioning of the magnetic main path member and the magnetic sub-path member. Thus, the use of the case per se as a magnetic sub-path member makes it easy to assemble the magnetic main path member and the magnetic sub-path member with reduced numbers of parts, and makes it possible to install the antenna in a housing without needing another case.

An antenna shown in FIG. 14(*b*) is the same as the antenna shown in FIG. 14(*a*), except that both end portions of a case 7*b* are made of a non-magnetic material. The case 7*b* is integrally formed by a resin containing a soft magnetic metal and a resin containing no soft magnetic metal. The case 7*b* having both end portions made of a non-magnetic material does not hinder a magnetic flux from entering from outside.

An antenna shown in FIG. 14(*c*) is substantially the same as shown in FIG. 14(*a*), except that both end surfaces of a magnetic core 4 are exposed. The case 7*c* has the same length as that of the magnetic core 4, and is in a shape engageable with the large-size end portions and small-size body portion of the magnetic core 4. In the magnetic core 4 having exposed end surfaces, too, a magnetic flux is not hindered from entering from outside. Because the magnetic core 4 is fitted in the case 7*c*, the magnetic core 4 is not easily detached from the case 7*c*, making assembling in a timepiece, etc. easy.

An antenna shown in FIG. 14(*d*) is substantially the same as shown in FIG. 14(*c*), except that both end portions of the magnetic core 4 are inclined. A magnetic main path member comprising a magnetic core 4 and a coil 8 is received in a case 7*d* with substantially no gap. After fitting the magnetic main path member in the case 7*d*, a non-magnetic resin may be injected, to embed the magnetic main path member in a resin in the housing.

An antenna shown in FIG. 15(*e*) comprises an integrally embedded magnetic core 4. The case 7*e* is made of a soft magnetic material. Because the case 7*e* is formed around the magnetic main path member without a gap, the deviation of position does not occur easily after assembled in a housing of a timepiece, etc., resulting in reduced unevenness in characteristics and less likelihood of breakage. The forming method of the case 7*e* may be, for instance, an injection molding.

An antenna shown in FIG. 15(*f*) is integrally formed with a case 7*f*, such that both end surfaces of a magnetic core 4 are exposed. The case 7*g* of the antenna shown in FIG. 15(*g*) comprises a non-magnetic part engaging an upper part of a magnetic main path member, and a soft magnetic part engaging a lower part of the magnetic main path member. The case 7*g* is obtained by simultaneously injection-molding a mixed material of soft magnetic metal flake and a resin and a resin containing no soft magnetic metal flake in an integral two-part structure. The case 7*h* covers only a lower part of a body portion of the magnetic main path member.

An antenna shown in FIG. 15(*i*) is the same as shown in FIG. 15(*e*), except for having a magnetic core 4 having the shape shown in FIG. 1(*e*) in a case 7*i*. Injection molding can produce cases engageable with magnetic cores 4 having various shapes.

Figure 16:
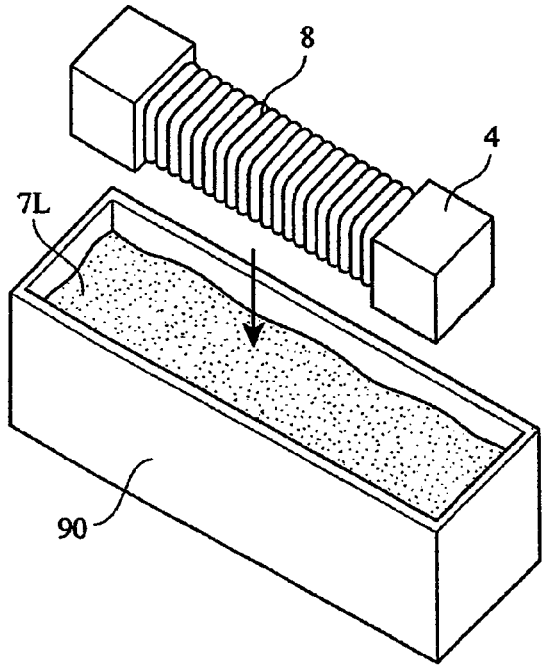
FIG. 16 is a perspective view showing an example of an antenna comprising a potting-molded case.

FIG. 16 shows one example of methods for forming a case. A curable slurry 7L containing soft magnetic powder is charged into a mold 90, and a magnetic main path member comprising a magnetic core 4 and a coil 8 is immersed in the curable slurry 7L and cured. This method is generally called "potting." Examples of the curable slurry include a slurry comprising soft magnetic powder, a thermosetting resin, an organic solvent, etc. It may be a thermally curable slurry or a volatile curable slurry.

Figure 18:
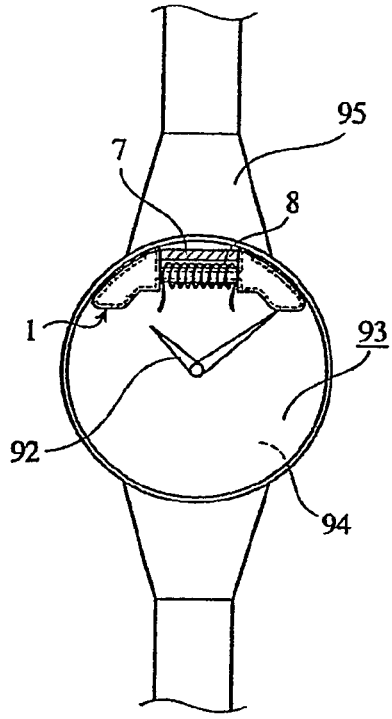
FIG. 18 is a view showing another example of the front and side of the radio-controlled wristwatch of the present invention.

FIG. 18 shows one example of the radio-controlled watches of the present invention. Though the antenna is not seen from a front side of the watch, it is depicted by a solid line in the front view to clarify its position, etc. The radio-controlled watch comprises a housing 95 made of a metal (for instance, stainless steel), a movement 92 and its peripheral parts, a glass cover 93, a rear cover 94 made of a metal (for instance, stainless steel), and an antenna 1 disposed between the movement 92 and the rear cover 94.

The antenna 1 has a basic shape shown in FIG. 8(*a*), which comprises a magnetic core 4, around which a coil 8 is wound, and a case 7 receiving the magnetic core 4. The magnetic core 4 is formed by a laminate of thin amorphous ribbons.

The case 7 absorbs impact from outside to protect the magnetic core 4, and functions as a magnetic sub-path to make it unnecessary to have a magnetic sub-path member separately, thereby needing only a limited space. Such antenna 1 is easily disposed in the housing 95 without hindering other parts such as the movement 92, etc. Incidentally, if the case 7 has a curved shape adapted for the inner wall of the housing 95, it is easily disposed in the housing 95.

The antenna 1 is arranged such that the end portions of the magnetic core 4 extend from the bottom surface toward the glass cover 93. Accordingly, the end portions or tip end portions of the magnetic core are in alignment with the direction of the incoming radio wave. As long as they are directed to easily receive radio waves, the direction of the end portions and their angles to the bottom surface are not restrictive.

Because indispensable movement and dial occupy most of the timepiece in volume, the antenna 1 has to be disposed near the rear cover 94, thereby being surrounded by metal parts. However, because the end portions of the magnetic core are directed not toward the housing 95 but toward non-metal parts (glass cover 93, etc.), the antenna 1 easily receives radio waves from outside. Namely, with the end portions of the magnetic core, which are most important to receive electromagnetic waves, directed toward non-metal parts such as a glass cover 93, etc., the radio wave-shielding effect of the metal housing 95 can be minimized. When part of the housing 95 is made of a non-metal material, the end portions of the magnetic core may be directed toward the non-metal part of the housing.

When the housing 95 is made of a metal, the magnetic sub-path member 7 is preferably away from the housing 95 to reduce the generation of eddy current. However, there are generally so many restrictions in space in the housing 95 that the magnetic sub-path member 7 cannot necessarily be arranged away from the housing 95. In addition, if the magnetic sub-path member 7 for adjusting sensitivity were directed inward the housing 95, its adjustment would be difficult. When the magnetic sub-path member 7 made of a soft composite is arranged along the inner periphery of the housing 95, the adjustment of thickness and area of the magnetic sub-path member 7 is easy, with space in the housing 95 effectively used. Thus, despite the disadvantage of eddy current, overwhelming advantages can be obtained. Of course, when there is no restriction in space, etc., the magnetic sub-path member 7 may be arranged separate from the housing 95. When the magnetic sub-path member 7 is separate from the metal housing 95, the incoming radio wave is easily focused in the magnetic core of the magnetic main path member, but less focused in the magnetic sub-path member 7. Thus, the effect of avoiding the generation of eddy current can be expected.

The uprising end portions of the magnetic core may appear on a dial surface of the timepiece as part of design. For instance, the end portions of the magnetic core may penetrate the dial. With such design, the end portions of the magnetic core exposed on the dial increase the sensitivity of the antenna.

Figure 19:
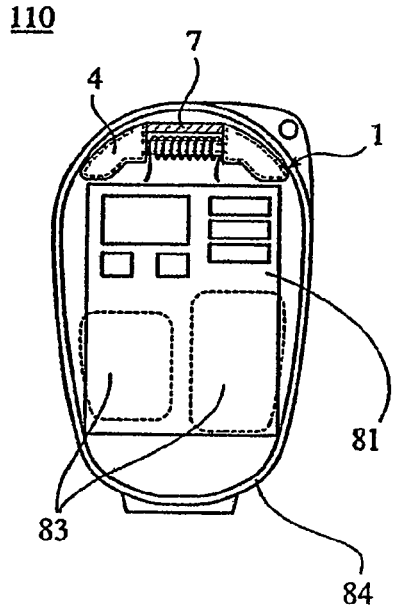
FIG. 19 is a view showing an example of the front and side of a key body in the keyless entry system of the present invention.

FIG. 19 shows a key body for a keyless entry system, one of the RFID tag. To clarify its arrangement, etc., the antenna 1 is shown by a solid line in the front view. The key body comprises a resin housing 84, a key-operating button 83, a receiving/transmitting circuit board 81, and an antenna 1. The circuit board 81 is formed by a metal member (printed circuit, etc.).

The end portions of the magnetic core in the antenna 1 are bent toward an upper surface of the key, such that they are deviated from the direction of a metal member constituting the circuit board 81. As depicted, the outer side surface of the magnetic core has a substantially circular shape complementary to the inner surface of the housing 84. A magnetic sub-path member 7 is received in a notch of the magnetic core between their end portions. With the antenna 1 having such a shape, a space inside the key body can be used effectively.

Figure 20:
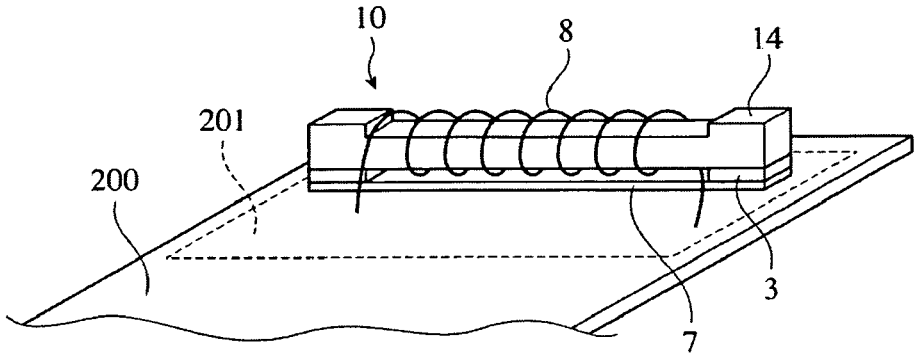
FIG. 20 is a perspective view showing an example of an antenna mounted onto a board.

As shown in FIG. 20, a magnetic core 14 may be connected to a long, sheet-shaped, magnetic sub-path member 7 via second magnetic sub-path members 3, the magnetic sub-path member 7 being bonded to a printed circuit board 200. With such arrangement, the end portions of the magnetic core 14 are positioned away from the printed circuit board 200.

The present invention will be explained in further detail referring to Examples below, without intension of restricting the present invention thereto.

Example 1

Using a 1-mm-diameter round ferrite rod available from Hitachi Metals, Ltd. having 7.5-mm-high bent portions at both ends and a 16-mm-long center portion between the bent portions as a magnetic core, it was insulated, and a 0.07-mm-diameter enameled copper wire was wound by 1200 turns around the insulated surface of the ferrite core in a 12-mm-long range, to produce the antenna shown in FIG. 1(*a*). The installing surface of the antenna was 1 mm wide and 16 mm long.

Example 2

A 15-μm-thick amorphous metal foil was punched in a U shape of 1 mm in width and 16 mm in distance between 7.5-mm-high bent portions, and 30 of these thin foils were laminated to form a 0.45-mm-thick laminate, whose surface was insulated. A 0.07-mm-diameter enameled copper wire was wound by 1200 turns around a center portion of the laminate in a 12-mm-long range, to produce an antenna having the shape shown in FIG. 1(*b*).

Comparative Example 1

An antenna was produced in the same manner as in Example 1, except for using a 1-mm-diameter round ferrite rod available from Hitachi Metals, Ltd. having a total length of 16 mm and no bent portions between both ends as a magnetic core.

Figure 21:
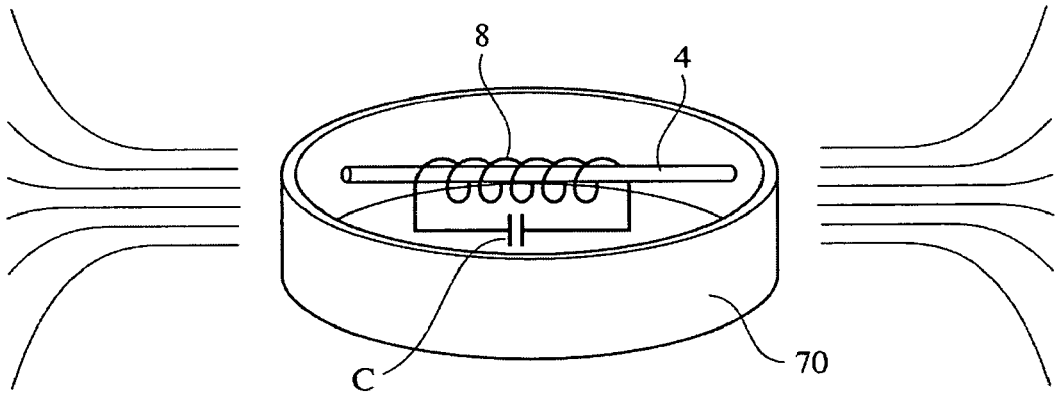
FIG. 21 is a schematic view showing a test apparatus used in Examples.
Figure 22:
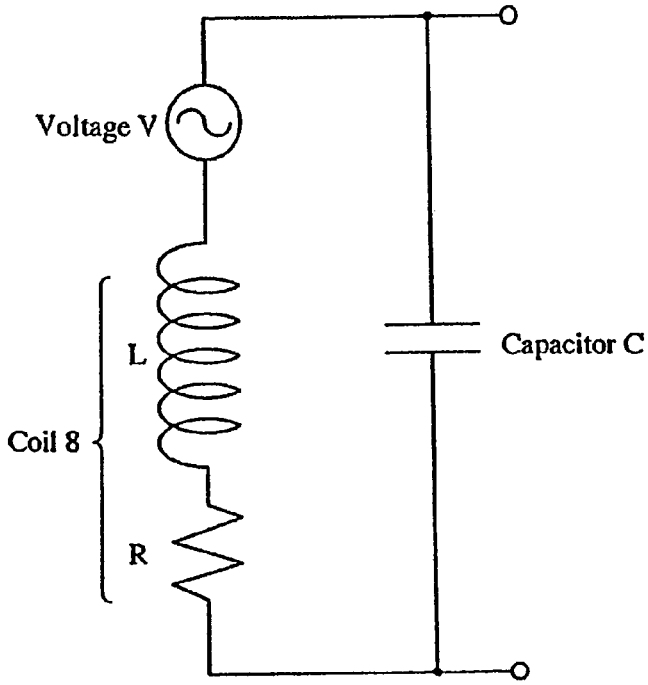
FIG. 22 is a view showing an equivalent circuit of one example of the antenna of the present invention.
Figure 23:
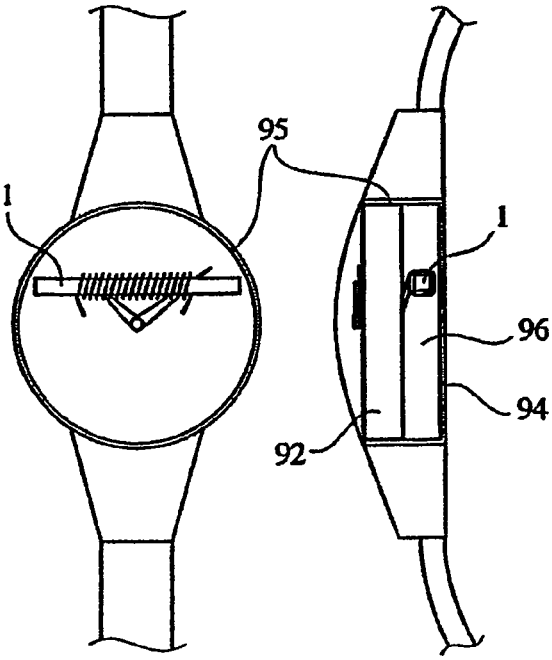
Fig. 23 (PRIOR ART)
FIG. 23 is a view showing the front and side of a radio-controlled wristwatch containing a conventional antenna.

With each antenna of Examples 1 and 2 and Comparative Example 1 installed in a test apparatus having a metal case 70 like a radio-controlled wristwatch, a magnetic field of 14 pT was applied from outside to measure an output voltage. The shape of the test apparatus used for voltage measurement is shown in FIG. 21. The metal case 70 was as thick as 1 mm. FIG. 22 shows the equivalent circuit of the antenna in Example 1. L and R correspond to the magnetic core 4 and the coil 8 in the antenna. A capacitor C is connected in parallel with the coil 8, to generate Q-times voltage at both ends of the capacitor by electric resonance with the coil 8. The measurement results of the output voltage are shown in Table 1.

TABLE 1

| Shape | Example 1 | Example 2 | Comparative Example 1 |
|---|---|---|---|
| Output Voltage | 7.4 μV | 7.2 μV | 6.1 μV |

Example 3

An antenna having a magnetic sub-path member was produced to measure output voltage and a Q value. The antenna of Example 2 was provided with a magnetic sub-path member 25*d* to produce the antenna shown in FIG. 4(*d*). The magnetic sub-path member 25*d* was constituted by the same thin ribbons (15-μm-thick amorphous metal foils) as in the magnetic core laminate, and the gap G was 1 mm. To confirm the effect of the magnetic sub-path member 25*d*, the antenna of Example 2 was measured with respect to output voltage and a Q value.

Example 4

A 15-μm-thick amorphous metal foil was punched to a width of 1 mm and a length of 31 mm, and 30 of the thin foils were laminated to a thickness of 0.45 mm. After insulating a surface of the resultant laminate core, a 0.07-mm-diameter enameled copper wire was wound by 1200 turns around it in a 12-mm-long range. Both end portions of the laminate were bent by 7.5 mm, and one amorphous metal foil was placed on the resultant magnetic core to provide an antenna. A small gap was provided between the bent end portions of the magnetic core and both end portions of the metal foil.

Without being disposed in a metal housing, a magnetic field of 14 pT was applied to each antenna of Examples 2-4 and Comparative Example 1 to measure output voltage and a Q value. The measurement results are shown in Table 2.

TABLE 2

| No. 3 | Example Example 4 | Example 2 | Example 1 | Comparative |
|---|---|---|---|---|
| Output Voltage | 69 μV | 81 μV | 66 μV | 57 μV |
| Q Value | 123 | 127 | 118 | 110 |

With a magnetic sub-path member attached to part of the magnetic core, part of a magnetic flux flowing into the magnetic core was retained, resulting in high Q value and output voltage. In the antenna having the magnetic sub-path member, less magnetic flux leaked, so that advantageous results are expected even when disposed in a metal housing.

Example 5

The antenna 20*c* of FIG. 4(*c*) was produced as follows: After insulating a surface of a Mn—Zn ferrite core (MT80D available from Hitachi Metals, Ltd.) having a square cross section of 1.5 mm each, which was 16 mm long between 7.5-mm-high bent portions, as a magnetic core, a 0.07-mm-diameter enameled copper wire was wound by 1200 turns around a center portion of the magnetic core between both bent portions in a 12-mm-long range. A thin ferrite (MT80D) sheet of 0.5 mm in thickness and 1.5 mm in width was attached to the magnetic core via an intermediate plastic (PET) member, to produce a magnetic sub-path member. Because the intermediate member was as thick as 0.2 mm, its gaps G on both sides were 0.2 mm. An installing area of this antenna was 1.5 mm wide and 16 mm long.

Example 6

The antenna 20*d* of FIG. 4(*d*) was produced as follows: A thin ribbon of 1 mm in width and 31 mm in length was punched out of an amorphous cobalt-based metal foil as thick as 15 μm (ACO-5SF, available from Hitachi Metals, Ltd.), and 30 of these thin ribbons were laminated to a thickness of 0.45 mm. After insulating a surface of the resultant laminate core, a 0.07-mm-diameter enameled copper wire was wound by 1200 turns around it in a 12-mm-long range, and both end portions of the magnetic core was bent to a height of 7.5 mm. The same amorphous thin sheet as in Example 5 was attached as a magnetic sub-path member to the magnetic core via an intermediate plastic (PET) member.

Comparative Example 2

A linear antenna was obtained in the same manner as in Example 5, except that winding was provided to a magnetic core of 1.5 mm in width, 16 mm in total length, and 2.5 mm in height of an upright winding stopper, and that no magnetic sub-path member was mounted.

With each antenna of Examples 5 and 6 and Comparative Example 2 installed in the test apparatus shown in FIG. 21, an alternating magnetic field of 14 pT at a frequency of 40 kHz as effective values was applied from outside to measure output voltage. The results are shown in Table 3.

TABLE 3

| No. | Example 5 | Example 6 | Comparative Example 2 |
|---|---|---|---|
| Output Voltage | 8.5 μV | 8.0 μV | 6.4 μV |

Examples 7-10

Figure 24:
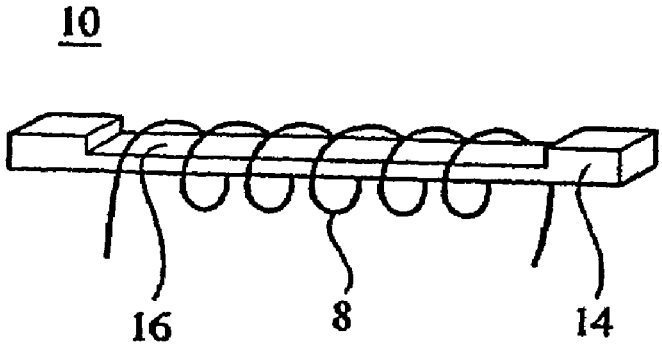
Fig. 24 (PRIOR ART)
FIG. 24 is a schematic view showing the conventional antenna.

The antenna 20*g* shown in FIG. 4(*g*) was produced as follows: Two ferrite members 25*g* of 0.5 mm in thickness and 1.5 mm in width were attached to a magnetic ferrite core 24*g* having the structure shown in FIG. 24 via plastic (PET) sheets. Using a plastic (PET) sheet having the thickness shown in Table 4, an antenna having a gap G between the end portions of the ferrite member was assembled.

Examples 11-16

The antenna 20*h* shown in FIG. 4(*h*) was produced as follows: One ferrite member 25*h* of 0.5 mm in thickness, 1.5 mm in width, and 16 mm in length was attached to a magnetic core 24*h* having the same structure as in Example 7 via plastic (PET) sheets having the thickness shown in Table 4. An antenna having gaps G between the ferrite member 25*h* and the magnetic core 24*h*.

Reference Examples 2-5

The antenna 20*h* shown in FIG. 4(*h*) was assembled in the same manner as in Examples 11-16 except for using a copper sheet of 0.25 mm in thickness, 10 mm in width, and 20 mm in length in place of a magnetic member for a magnetic sub-path member.

With each antenna not disposed in a metal housing, an alternating magnetic field of 14 pT at a frequency of 40 kHz as effective values was applied to measure output voltage. The measurement of a Q value was conducted at a drive voltage of 0.05 V using an impedance meter. The results are shown in Table 4.

TABLE 4

| No. | Magnetic Core Material | Material of Magnetic Sub-Path Member | Gap G* (mm) | Output Voltage (μV) | Q Value |
|---|---|---|---|---|---|
| Example 7 | Ferrite | Ferrite | 1.0 | 67 | 124 |
| Example 8 | | | 2.0 | 69 | 123 |
| Example 9 | | | 3.0 | 68 | 122 |
| Example 10 | | | 4.0 | 66 | 121 |
| Example 11 | Ferrite | Ferrite | 0 | 20 | 300 |

TABLE 4-continued

| No. | Magnetic Core Material | Material of Magnetic Sub-Path Member | Gap G* (mm) | Output Voltage (μV) | Q Value |
|---|---|---|---|---|---|
| Example 12 | | | 0.025 | 63 | 160 |
| Example 13 | | | 0.1 | 65 | 136 |
| Example 14 | | | 0.2 | 66 | 140 |
| Example 15 | | | 0.5 | 67 | 139 |
| Example 16 | | | 1.0 | 65 | 132 |
| Reference Example 2 | Ferrite | Copper Sheet | 0.1 | — | 16.9 |
| Reference Example 3 | | | 0.5 | — | 18.3 |
| Reference Example 4 | | | 2.0 | — | 36.5 |
| Reference Example 5 | | | 8.0 | — | 103 |
| Comparative Example 1 | Ferrite | Non | — | 57 | 110 |

Note:
gap G corresponds to the thickness of a plastic (PET) sheet.

Examples 7-10 exhibited higher output voltage and Q value than Comparative Example 1, confirming the effect of having a magnetic sub-path member with a magnetic gap G. However, the output voltage and the Q value were lower in Example 10 having a gap G of 4.0 mm than in Example 9 having a gap G of 3.0 mm. Also, when the gap G is less than 1.0 mm, the output voltage tends to decrease.

In Examples 11-16, the gap G for providing a well-balanced combination of output voltage and a Q value was 0.5 mm. Though a smaller gap G tends to lower output voltage, a higher output voltage was obtained even in Example 12 having a gap G of 0.025 mm than in Comparative Example.

Output voltage measurement was not conducted in Reference Example 2, which resembles the structure of JP 2002-168978 A with a conductive shield member, because its output voltage appeared to be incommensurably lower than those of Examples 7-16. When the gap G is 0 mm, it is considered that a magnetic flux is not well captured, resulting in drastic decrease in output voltage. Why a high Q value was obtained at a gap G of 8.0 mm appears to be due to the fact that the influence of the copper sheet disappeared.

As described above, the magnetic sub-path member with a magnetic gap could retain part of the magnetic flux flowing into the magnetic core, resulting in high Q value and output voltage. The preferred size of the gap G is between about 0.025 mm and about 3 mm, despite some difference by the antenna structure. Because the antenna with a magnetic sub-path member radiates only a small amount of magnetic flux by a resonance current, advantageous results were obtained even when the antennas of Examples 7-10 and 12-16 were disposed in a metal housing.

Example 17

The antenna shown in FIGS. 8(*a*) and 8(*b*) was produced as follows: After insulating a surface of a 16-mm-long Mn—Zn ferrite core (MT80D available from Hitachi Metals, Ltd.) having a square cross section of 1.5 mm each as a magnetic core, a 0.07-mm-diameter enameled copper wire was wound by 1200 turns around a center portion of the magnetic core in a 12-mm-long range. A ferrite sheet of 0.5 mm in thickness and 1.5 mm in width having a permeability of 500 was bonded as a magnetic sub-path member 3*a* to the end portions of the magnetic core.

Examples 18-22

An antenna was assembled in the same manner as in Example 17, except for using a second magnetic sub-path member (soft composite) 3*b* having a thickness t shown in Table 5. With each antenna installed in the metal case 70 shown in FIG. 21, an alternating magnetic field of 14 pT at a frequency of 40 kHz as effective values was applied to measure output voltage. The results are shown in Table 5.

TABLE 5

| No. | Thickness of Soft Composite t (mm) | Q Value | Output Voltage (μV) |
|---|---|---|---|
| Example 17 | 0 | 106 | 7.1 |
| Example 18 | 0.25 | 113 | 14.0 |
| Example 19 | 0.5 | 119 | 15.7 |
| Example 20 | 1.0 | 125 | 15.6 |
| Example 21 | 1.5 | 124 | 13.1 |
| Example 22 | 2.0 | 123 | 11.9 |

Example 23

The antenna shown in FIGS. 8(*a*) and 8(*b*) was produced as follows: After insulating a surface of a 16-mm-long Mn—Zn ferrite core (MT80D available from Hitachi Metals, Ltd.) having a square cross section of 1.5 mm each as a magnetic core, a 0.07-mm-diameter enameled copper wire was wound by 1200 turns around a center portion of the magnetic core in a 12-mm-long range. A magnetic sub-path member 3*a* of 0.25 mm in thickness and 1.5 mm in width made of a soft composite having a permeability of 50 was bonded to the end portions of the magnetic core.

Examples 24-27

An antenna was assembled in the same manner as in Example 23 except for changing the thickness of the magnetic sub-path member (soft composite) 3*a* as shown in Table 6. With each antenna installed in the metal case 70 shown in FIG. 21, a magnetic field of 14 pT and a frequency of 40 kHz was applied to measure a Q value and sensitivity (output voltage). The results are shown in Table 6. For comparison, this table also shows the output voltage and Q value of an antenna having the same structure and material as in Example 23 except for having no magnetic sub-path member (Comparative Example 3).

TABLE 6

| No. | Thickness of Soft Composite t (mm) | Q Value | Output Voltage (μV) |
|---|---|---|---|
| Example 23 | 0.25 | 115 | 8.0 |
| Example 24 | 0.5 | 119 | 10.9 |
| Example 25 | 1.0 | 120 | 12.6 |
| Example 26 | 1.5 | 122 | 10.7 |
| Example 27 | 2.0 | 123 | 10.0 |
| Comparative Example 3 | 0* | 106 | 7.1 |

Note:
*No magnetic sub-path member.

It was confirmed that the provision of the magnetic sub-path member contributed to improving the Q value and sensitivity. The Q value and sensitivity depended on the thickness of the soft composite. Accordingly, to obtain the maximum effect of the magnetic sub-path member, the first and/or second magnetic sub-path member should be in a preferred thickness range. The thickness t providing high Q value and sensitivity was, for instance, 0.5-1.0 mm in Examples 17-22, and 1.0-2.0 mm in Examples 23-27.

It is considered that even when the magnetic main path member and the first magnetic sub-path member are laminates or made of different materials from above, high Q value and sensitivity can be easily obtained by changing the thickness of the second magnetic sub-path member. The same adjustment can be done by a contact area, too. Thus, the adjustment of a Q value and sensitivity by the thickness of the magnetic sub-path member or by the contact area with the magnetic core is much easier than the micron-level adjustment of a gap, which is necessary for an air gap.

Example 28

As shown in FIG. 20, a magnetic path member 7 and a pair of magnetic sub-path members 3 were attached to a printed circuit board 200 in this order, and end portions of a magnetic core were bonded to the magnetic sub-path member 3 to produce a key body. The end portions of the magnetic core were directed away from the printed circuit board. Incidentally, the magnetic core was made of Mn—Zn ferrite (MT80D available from Hitachi Metals, Ltd.), the magnetic sub-path member 3 was formed by Absorshield® K-E050 available from Hitachi Metals, Ltd., and the magnetic sub-path member 7 was formed by Absorshield® K-E025 available from Hitachi Metals, Ltd. The antenna was 11 mm long, 2.9 mm high and 3 mm wide as a whole. The magnetic sub-path member 3 was as thick as 0.5 mm, and the magnetic sub-path member 7 was as thick as 0.25 mm. An iron sheet 201 was attached to an entire rear surface of the printed circuit board on an opposite side of an antenna-installing surface. The measurement of sensitivity (output voltage) was conducted in a magnetic field of 45 nT at a frequency of 125 KHz. The measured output voltage and Q value are shown in Table 7. For comparison, this table also shows the output voltage and Q value of an antenna having the same structure and material as in Example 28 except for having no magnetic sub-path member (Comparative Example 4).

TABLE 7

| No. | Example 28 | Comparative Example 4 |
|---|---|---|
| Q value | 30.2 | 13.5 |
| Output Voltage (mV) | 1.76 | 1.22 |

The key body comprising the antenna of the present invention exhibited excellent output voltage and Q value.

What is claimed is:

1. A radio-controlled timepiece, comprising:

a housing;

a magnetic sensor-type antenna disposed in the housing, the antenna comprising a magnetic core and a coil wound around the magnetic core for receiving a radio wave; and a non-metal cover disposed in front of a dial surface, wherein end portions of the magnetic core are bent in a direction toward the non-metal cover.

2. The radio-controlled timepiece according to claim 1, wherein the magnetic core further has bent tip end portions.

3. The radio-controlled timepiece according to claim 1, wherein the magnetic core has a plurality of branched end portions, at least one of which is bent in a direction toward the non-metal cover.

4. The radio-controlled timepiece according to claim 3, wherein at least one of the plurality of end portions is bent in a direction toward the non-metal cover, and at least one of the remaining end portions being bent in a different direction.

5. The radio-controlled timepiece according to claim 1, wherein end portions of the magnetic core are shaped along an inner wall of the housing.

6. The radio-controlled timepiece according to claim 1, wherein end portions of the magnetic core are inclined with respect to a center portion of the magnetic core.

7. The radio-controlled timepiece according to claim 1, wherein end portions of the magnetic core are inclined with respect to a center portion of the magnetic core, and tip end portions of the magnetic core being bent such that the tip end portions are in parallel with the center portion of the magnetic core.

8. The radio-controlled timepiece according to claim 1, wherein the magnetic core is a bundle of plural metal wires.

9. The radio-controlled timepiece according to claim 1, wherein the magnetic core is a laminate of plural thin ribbons.

10. A magnetic sensor-type antenna for receiving a radio wave, the antenna comprising:

a magnetic main path member further comprising a magnetic core and a coil wound around the magnetic core; and a magnetic sub-path member attached to the magnetic core without an air gap, the magnetic sub-path member being made of a material having a smaller specific permeability than that of the magnetic core.

11. The magnetic sensor-type antenna according to claim 10, wherein the magnetic sub-path member has a specific permeability of 2 or more, lower than that of the magnetic main path member.

12. The magnetic sensor-type antenna according to claim 10, wherein the magnetic sensor-type antenna is disposed in a housing, and further wherein end portions of the magnetic core are bent in a direction away from the housing or a metal part of the housing.

13. A magnetic sensor-type antenna for receiving a radio wave, the antenna comprising:

a magnetic main path member further comprising a magnetic core and a coil wound around the magnetic core; and a magnetic sub-path member attached to the magnetic core, the magnetic sub-path member including a first magnetic sub-path member, and a second magnetic sub-path member sandwiched by the first magnetic sub-path member and the magnetic core without an air gap, and the second magnetic sub-path member having a smaller specific permeability than that of the first magnetic sub-path member.

14. The magnetic sensor-type antenna according to claim 10 or 13, wherein the magnetic sub-path member is formed by a soft composite comprising a soft magnetic ferrite or metal powder or soft magnetic metal flake, and a resin or a rubber.

15. The magnetic sensor-type antenna according to claim 10 or 13, wherein the magnetic sub-path member is formed by application of a paint containing soft magnetic powder to the magnetic main path member.

16. The magnetic sensor-type antenna according to claim 10 or 13, wherein the magnetic core comprises a plurality of metal wires.

17. The magnetic sensor-type antenna according to claim 10 or 13, wherein the magnetic core comprises a laminate of a plurality of thin ribbons.

18. The magnetic sensor-type antenna according to claim 13, wherein the magnetic core and the first magnetic sub-path member are laminates of thin, soft magnetic metal ribbons.

19. The magnetic sensor-type antenna according to claim 10 or 13, wherein the magnetic core is a laminate of a plurality of thin ribbons, and further wherein the magnetic sub-path member is disposed on a stratum-appearing surface of the magnetic main path member.

20. The magnetic sensor-type antenna according to claim 10 or 13, wherein the magnetic sub-path member is a laminate of a plurality of thin ribbons, and further wherein the magnetic main path member and the magnetic sub-path member are aligned in the same lamination direction.

21. The magnetic sensor-type antenna according to claim 13, wherein the magnetic sensor-type antenna is disposed in a metal housing, and further wherein end portions of the magnetic core are bent in a direction away from the metal housing.

22. The magnetic sensor-type antenna according to claim 13, wherein the magnetic sensor-type antenna is disposed in a metal or non-metal housing together with other metal parts than the antenna, and further wherein end portions of the magnetic core are bent in a direction away from the other metal parts.

23. A magnetic sensor-type antenna, comprising:

a magnetic core and a coil wound around the magnetic core for receiving a radio wave; and a case in which the magnetic core and the coil are disposed, wherein the case is in contact with end portions of the magnetic core, and further wherein the case has a specific permeability of 2 or more, smaller than that of the magnetic core.

24. The magnetic sensor-type antenna according to claim 23, wherein the magnetic core has a body portion disposed in the case and end portions exposed from the case.

25. The magnetic sensor-type antenna according to claim 23, wherein the magnetic core and the coil wound around the magnetic core constitute a magnetic main path member, and wherein the magnetic main path member is fit in the case.

26. The magnetic sensor-type antenna according to claim 23, wherein the case is injection-molded.

27. A radio-controlled timepiece, comprising the magnetic sensor-type antenna recited in any one of claim 13 or 23, in a metal housing.

28. A keyless entry system, comprising a transmitter and a receiver, at least one of the transmitter and the receiver containing the magnetic sensor-type antenna recited in any one of claim 13 or 23.

29. An RFID system, comprising the magnetic sensor-type antenna recited in any one of claim 13 or 23 in an RFID tag.

30. A magnetic sensor-type antenna comprising:

a magnetic core and a coil wound around the magnetic core for receiving a radio wave; and a case in which the magnetic core and the coil are disposed, wherein the case includes a soft magnetic case portion for receiving a body portion of the magnetic core, and end portions extending from the soft magnetic case portion for receiving end portions of the magnetic core, wherein the soft magnetic case portion has a specific permeability of 2 or more, smaller than that of the magnetic core, and further wherein end portions of the case have a smaller specific permeability than that of the soft magnetic case portion.

31. A magnetic sensor-type antenna comprising:

a magnetic core and a coil wound around the magnetic core for receiving a radio wave; and a case in which the magnetic core and the coil are disposed, wherein the case including a soft magnetic case portion for receiving a body portion of the magnetic core, and non-magnetic case portions extending from the soft magnetic case portion for receiving end portions of the magnetic core, and further wherein the soft magnetic case portion has a specific permeability of 2 or more, smaller than that of the magnetic core.

32. A magnetic sensor-type antenna comprising:

a magnetic core and a coil wound around the magnetic core for receiving a radio wave; and a case in which the magnetic core and the coil are disposed, wherein the case has a specific permeability of 2 or more, smaller than that of the magnetic core, and further wherein the case is obtained by placement of a magnetic main path member comprising the magnetic core and the coil wound around the magnetic core into a curable slurry charged into a mold and subsequently cured.

33. A magnetic sensor-type antenna, comprising:

a magnetic core and a coil wound around the magnetic core for receiving a radio wave, and a case in which the magnetic core and the coil are disposed, wherein the case has a specific permeability of 2 or more, smaller than that of the magnetic core, wherein the magnetic sensor-type antenna is disposed in a metal housing, and further wherein end portions of the magnetic core are bent in a direction away from the metal housing.

34. A magnetic sensor-type antenna, comprising:

a magnetic core and a coil wound around the magnetic core for receiving a radio wave; and a case in which the magnetic core and the coil are disposed, wherein the case has a specific permeability of 2 or more, smaller than that of the magnetic core, wherein the magnetic sensor-type antenna is disposed in a metal or non-metal housing together with other metal parts than the antenna, and further wherein end portions of the magnetic core are bent in a direction away from the metal parts.

35. The magnetic sensor-type antenna according to claim 22 or 34, wherein the end portions of the magnetic core are substantially in parallel with a bottom surface of the metal or non-metal housing.

* * * * *